US009494035B2

(12) United States Patent
Logan et al.

(10) Patent No.: US 9,494,035 B2
(45) Date of Patent: Nov. 15, 2016

(54) FLUID PRESSURE PULSE GENERATOR AND METHOD OF USING SAME

(71) Applicant: Evolution Engineering Inc., Calgary (CA)

(72) Inventors: Aaron W. Logan, Calgary (CA); David A. Switzer, Calgary (CA); Justin C. Logan, Calgary (CA); Jili Liu, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days.

(21) Appl. No.: 14/440,670

(22) PCT Filed: Nov. 6, 2013

(86) PCT No.: PCT/CA2013/050843

§ 371 (c)(1),
(2) Date: May 5, 2015

(87) PCT Pub. No.: WO2014/071514

PCT Pub. Date: May 15, 2014

(65) Prior Publication Data

US 2015/0292322 A1 Oct. 15, 2015

Related U.S. Application Data

(60) Provisional application No. 61/865,522, filed on Aug. 13, 2013, provisional application No. 61/723,129, filed on Nov. 6, 2012.

(51) Int. Cl.

| | |
|---|---|
| ***E21B 47/18*** | (2012.01) |
| ***E21B 34/06*** | (2006.01) |
| *E21B 10/34* | (2006.01) |

(52) U.S. Cl.
CPC ..... *E21B 47/18* (2013.01); *E21B 34/06* (2013.01); *E21B 10/34* (2013.01)

(58) Field of Classification Search
CPC ..... E21B 21/10; E21B 21/103; E21B 28/00; E21B 34/00; E21B 47/18; E21B 47/182; E21B 47/185; E21B 47/187
See application file for complete search history.

(56) References Cited

U.S. PATENT DOCUMENTS

| | | | |
|---|---|---|---|
| 3,302,457 | A | 2/1967 | Mayes |
| 3,309,656 | A | 3/1967 | Godbey |

(Continued)

FOREIGN PATENT DOCUMENTS

| | | | |
|---|---|---|---|
| CA | 1 228 909 | A | 11/1987 |
| CA | 1 229 998 | A | 12/1987 |

(Continued)

*Primary Examiner* — Brad Harcourt
(74) *Attorney, Agent, or Firm* — Seed IP Law Group PLLC

(57) ABSTRACT

A fluid pressure pulse generator comprising a stator and rotor that can be used in measurement while drilling using mud pulse or pressure pulse telemetry is disclosed. The stator comprises a stator body with a circular opening therethrough and the rotor comprises a circular rotor body rotatably received in the circular opening of the stator body. One of the stator body or the rotor body comprises one or more than one fluid opening for flow of fluid therethrough and the other of the stator body or the rotor body comprises one or more than one full flow chamber. The rotor is rotatable between a full flow configuration whereby the full flow chamber and the fluid opening align so that fluid flows from the full flow chamber through the fluid opening, and a reduced flow configuration whereby the full flow chamber and the fluid opening are not aligned. The flow of fluid through the fluid opening in the reduced flow configuration is less than the flow of fluid through the fluid opening in the full flow configuration thereby generating a fluid pressure pulse.

30 Claims, 16 Drawing Sheets

(56) References Cited

U.S. PATENT DOCUMENTS

| | | | |
|---|---|---|---|
| 3,764,968 | A | 10/1973 | Anderson |
| 3,770,006 | A | 11/1973 | Sexton et al. |
| 3,958,217 | A | 5/1976 | Spinnler |
| 3,982,224 | A | 9/1976 | Patton |
| 4,134,100 | A | 1/1979 | Funke |
| 4,189,705 | A | 2/1980 | Pitts, Jr. |
| 4,260,030 | A | 4/1981 | Fox |
| 4,351,037 | A | 9/1982 | Scherbatskoy |
| 4,562,560 | A | 12/1985 | Kamp |
| 4,641,289 | A | 2/1987 | Jürgens |
| 4,675,852 | A | 6/1987 | Russell et al. |
| 4,691,203 | A | 9/1987 | Rubin et al. |
| 4,734,892 | A | 3/1988 | Kotlyar |
| 4,771,408 | A | 9/1988 | Kotlyar |
| 4,785,300 | A | 11/1988 | Chin et al. |
| 4,830,122 | A | 5/1989 | Walter |
| 4,839,870 | A | 6/1989 | Scherbatskoy |
| 4,847,815 | A | 7/1989 | Malone |
| 4,914,637 | A | 4/1990 | Goodsman |
| 4,953,595 | A | 9/1990 | Kotlyar |
| 4,979,577 | A | 12/1990 | Walter |
| 5,073,877 | A | 12/1991 | Jeter |
| 5,079,750 | A | 1/1992 | Scherbatskoy |
| 5,182,730 | A | 1/1993 | Scherbatskoy |
| 5,182,731 | A | 1/1993 | Hoelscher et al. |
| 5,215,152 | A | 6/1993 | Duckworth |
| 5,237,540 | A | 8/1993 | Malone |
| 5,249,161 | A | 9/1993 | Jones et al. |
| 5,316,610 | A | 5/1994 | Tamaki et al. |
| 5,396,965 | A | 3/1995 | Hall et al. |
| 5,583,827 | A | 12/1996 | Chin |
| 5,586,083 | A | 12/1996 | Chin et al. |
| 5,586,084 | A | 12/1996 | Barron et al. |
| 5,636,178 | A | 6/1997 | Ritter |
| 5,740,126 | A | 4/1998 | Chin et al. |
| 5,740,127 | A | 4/1998 | Van Steenwyk et al. |
| 5,787,052 | A | 7/1998 | Gardner et al. |
| 5,950,736 | A | 9/1999 | Goldstein |
| 6,016,288 | A | 1/2000 | Frith |
| 6,219,301 | B1 | 4/2001 | Moriarty |
| 6,279,670 | B1 | 8/2001 | Eddison et al. |
| 6,414,905 | B1 | 7/2002 | Owens et al. |
| 6,469,637 | B1 | 10/2002 | Seyler et al. |
| 6,626,253 | B2 | 9/2003 | Hahn et al. |
| 6,714,138 | B1 | 3/2004 | Turner et al. |
| 6,750,783 | B2 | 6/2004 | Rodney |
| 6,850,463 | B2 | 2/2005 | Winnacker |
| 6,867,706 | B2 | 3/2005 | Collette |
| 6,898,150 | B2 | 5/2005 | Hahn et al. |
| 6,970,398 | B2 | 11/2005 | Lavrut et al. |
| 6,975,244 | B2 | 12/2005 | Hahn et al. |
| 7,138,929 | B2 | 11/2006 | Jeffryes et al. |
| 7,145,834 | B1 | 12/2006 | Jeter |
| 7,180,826 | B2 | 2/2007 | Kusko et al. |
| 7,230,880 | B2 | 6/2007 | Lehr |
| 7,250,873 | B2 | 7/2007 | Hahn et al. |
| 7,280,432 | B2 | 10/2007 | Hahn et al. |
| 7,319,638 | B2 | 1/2008 | Collette |
| 7,327,634 | B2 | 2/2008 | Perry et al. |
| 7,330,397 | B2 | 2/2008 | Ganesan et al. |
| 7,367,229 | B2 | 5/2008 | Engström |
| 7,400,262 | B2 | 7/2008 | Chemali et al. |
| 7,405,998 | B2 | 7/2008 | Webb et al. |
| 7,417,920 | B2 | 8/2008 | Hahn et al. |
| 7,468,679 | B2 | 12/2008 | Feluch |
| 7,552,761 | B2 | 6/2009 | Moriarty |
| 7,564,741 | B2 | 7/2009 | Pratt et al. |
| 7,719,439 | B2 | 5/2010 | Pratt et al. |
| 7,735,579 | B2 | 6/2010 | Gopalan et al. |
| 7,808,859 | B2 | 10/2010 | Hahn et al. |
| 7,839,719 | B2 | 11/2010 | Dopf et al. |
| 7,881,155 | B2 | 2/2011 | Close |
| 8,151,905 | B2 | 4/2012 | Song |
| 8,174,929 | B2 | 5/2012 | Camwell et al. |
| 8,203,908 | B2 | 6/2012 | Pratt et al. |
| 8,251,160 | B2 | 8/2012 | Gopalan et al. |
| 8,474,264 | B2 | 7/2013 | McCutchen |
| 8,485,264 | B2 | 7/2013 | Hutin et al. |
| 9,238,965 | B2 | 1/2016 | Brugess |
| 2006/0034154 | A1 | 2/2006 | Perry et al. |
| 2008/0002525 | A1 | 1/2008 | Pratt et al. |
| 2009/0038851 | A1 | 2/2009 | Camwell et al. |
| 2009/0280912 | A1 | 11/2009 | Buchanan et al. |
| 2010/0212963 | A1 | 8/2010 | Gopalan et al. |
| 2011/0005835 | A1 | 1/2011 | Li |
| 2011/0168410 | A1 | 7/2011 | deboer |
| 2011/0243761 | A1 | 10/2011 | Darsey |
| 2012/0085583 | A1 | 4/2012 | Logan et al. |
| 2012/0127829 | A1 | 5/2012 | Sitka |
| 2012/0195442 | A1 | 8/2012 | Villemoes et al. |
| 2013/0206401 | A1 | 8/2013 | Bhoite et al. |
| 2015/0041217 | A1 | 2/2015 | Gust |
| 2015/0233237 | A1 | 8/2015 | Logan et al. |
| 2015/0233238 | A1 | 8/2015 | Logan et al. |
| 2015/0275660 | A1 | 10/2015 | Logan et al. |
| 2015/0330217 | A1 | 11/2015 | Liu et al. |

FOREIGN PATENT DOCUMENTS

| | | | |
|---|---|---|---|
| CA | 2551316 | A1 | 12/2007 |
| CA | 2 506 808 | C | 10/2010 |
| CA | 2 855 940 | A1 | 6/2013 |
| GB | 2457175 | B | 5/2011 |
| WO | 94/05893 | A1 | 3/1994 |
| WO | 2005/084281 | A2 | 9/2005 |
| WO | 2006/130606 | A2 | 12/2006 |
| WO | 2007/033126 | A2 | 3/2007 |
| WO | 2009/033146 | A2 | 3/2009 |
| WO | 2010/138961 | A2 | 12/2010 |
| WO | 2012/027245 | A1 | 3/2012 |
| WO | 2012/027633 | A2 | 3/2012 |
| WO | 2012/130936 | A1 | 10/2012 |
| WO | 2012/145637 | A2 | 10/2012 |
| WO | 2014/071514 | A1 | 5/2014 |

FLUID PRESSURE PULSE GENERATOR AND METHOD OF USING SAME

FIELD

This disclosure relates generally to a fluid pressure pulse generator and method of using same and more particularly to a fluid pressure pulse generator comprising a stator and rotor for use in measurement while drilling using mud pulse or pressure pulse telemetry.

BACKGROUND

The recovery of hydrocarbons from subterranean zones relies on the process of drilling wellbores. This process includes drilling equipment situated at surface and a drill string extending from the surface equipment to the formation or subterranean zone of interest. The drill string can extend thousands of feet or meters below the surface. The terminal end of the drill string includes a drill bit for drilling, or extending, the wellbore. The process also relies on some sort of drilling fluid system, in most cases a drilling "mud". The mud is pumped through the inside of the drill string, which cools and lubricates the drill bit and then exits out of the drill bit and carries rock cuttings back to surface. The mud also helps control bottom hole pressure and prevents hydrocarbon influx from the formation into the wellbore and potential blow out at the surface.

Directional drilling is the process of steering a well from vertical to intersect a target endpoint or to follow a prescribed path. At the terminal end of the drill string is a bottom hole assembly (BHA) which may include 1) the drill bit; 2) steerable downhole mud motor of a rotary steerable system; 3) sensors of survey equipment for logging while drilling (LWD) and/or measurement while drilling (MWD) to evaluate downhole conditions as drilling progresses; 4) apparatus for telemetry of data to surface; and 5) other control equipment such as stabilizers or heavy weight drill collars. The BHA is conveyed into the wellbore by a string of metallic tubulars known as the drill string. MWD equipment may be used to provide downhole sensor and status information at the surface while drilling in a near real-time mode. This information is used by the rig crew to make decisions about controlling and steering the well to optimize the drilling speed and trajectory based on numerous factors, including lease boundaries, existing wells, formation properties, hydrocarbon size and location. These decisions can include making intentional deviations from the planned wellbore path as necessary, based on the information gathered from the downhole sensors during the drilling process. In its ability to obtain real time data, MWD allows for a relatively more economical and efficient drilling operation.

In known MWD systems, the MWD tools typically contain the same sensor package to survey the well bore, but various telemetry methods may be used to send the data back to the surface. Such telemetry methods include, but are not limited to, the use of hardwired drill pipe, acoustic telemetry, use of fibre optic cable, mud pulse (MP) telemetry and electromagnetic (EM) telemetry.

MP Telemetry involves creating pressure pulses in the circulating drill mud in the drill string. Mud is circulated from the surface to downhole using positive displacement pumps. The resulting flow rate of mud is typically constant. Pressure pulses are generated by changing the flow area and/or flow path of the drilling mud as it passes the MWD tool in a timed, coded sequence, thereby creating pressure differentials in the drilling mud. The pressure pulses act to transmit data utilizing a number of encoding schemes. These schemes may include amplitude phase shift keying (ASK), frequency shift keying (FSK), phase shift keying (PSK), or a combination of these techniques.

The pressure differentials or pulses may either be negative pulses or positive pulses. Valves that open and close a bypass mud stream from inside the drill pipe to the wellbore annulus create a negative pressure pulse. All negative pulsing valves need a high differential pressure below the valve to create a sufficient pressure drop when the valve is open; this results in the negative valves being more prone to washing. With each actuation, the valve hits against the valve seat to ensure it completely closes the bypasses and this impact can lead to mechanical and abrasive wear and failure. Valves that use a controlled restriction within the circulating mud stream create a positive pressure pulse. Some valves are hydraulically powered to reduce the required actuation power typically resulting in a main valve indirectly operated by a pilot valve. The pilot valve closes a flow restriction which actuates the main valve to create a pressure change.

A number of different valves are currently used to create positive pressure pulses. In a typical rotary or rotating disc valve pulser, a control circuit activates a motor (e.g. a brushless, DC electric motor) that rotates a "windowed restrictor" or rotor, relative to a fixed housing (stator) to allow (open the window) or restrict (close the window) fluid flow through the restrictor. It is the variable alignment of the rotor and stator that produces the 'windows of fluid flow', and the movement between aligned (open) and misaligned (closed) that produces the pressure pulses. The rotor is rotated either continuously in one direction (mud siren), incrementally by oscillating the rotor in one direction and then back to its original position, or incrementally in one direction only, so that the rotor blades increase or decrease the amount by which they obstruct the windows in the stator. As the rotor rotates, it partially blocks a portion of the window, fluid becomes restricted causing a change in pressure over time. Generally, mud pulse valves are capable of generating discrete pulses at a predetermined frequency by selective restriction of the mud flow.

Rotary pulsers are typically actuated by means of a torsional force applicator which rotates the rotor a short angular distance to either open or close the pulser, with the rotor returning to its start position in each case. Motor speed changes are required to change the pressure pulse frequency. Various parameters can affect the mud pulse signal strength and rate of attenuation such as original signal strength, carrier frequency, depth between surface transducer and downhole modulator, internal diameter of the drill pipe, density and viscosity of the drilling fluid, volumetric flow rate of drilling mud, and flow area of window. Rotary valve pulsers require an axial gap between the stator and rotor of the modulator to provide a flow area for drilling mud, even when the valve is in the "closed" position. As a result the rotary pulser is never completely closed as the drilling mud must maintain a continuous flow for satisfactory drilling operations to be conducted. The size of the gap is dictated by previously mentioned parameters, and a skilled technician is required to set the correct gap size and to calibrate the pulser.

Another type of valve is a "poppet" or reciprocating pulser where the valve opens and closes against an orifice positioned axially against the flow stream. Some have permanent magnets to keep the valve in an open position. The permanent magnet is opposed by a magnetizing coil powered by the MWD tool to release the poppet to close the valve.

U.S. Pat. No. 8,251,160, issued Aug. 28, 2012, discloses an example of a MP apparatus and method of using same. It highlights a number of examples of various types of MP generators, or "pulsers", which are familiar to those skilled in the art. U.S. Pat. No. 8,251,160 describes a rotor/stator design with windows in the rotor which align with windows in the stator. The stator also has a plurality of circular openings for flow of fluid therethrough. In a first orientation, the windows in the stator and the rotor align to create a fluid flow path orthogonal to the windows through the rotor and stator in addition to a fluid flow path through the circular openings in the stator. In this fashion the circulating fluid flows past and through the stator on its way to the drill bit without any significant obstruction to its flow. In the second orientation, the windows in the stator and the rotor do not align and there is restriction of fluid flow as the fluid can only flow through the circular holes in the stator. This restriction creates a positive pressure pulse which is transmitted to the surface and decoded.

Advantages of MP telemetry include increased depth capability, no dependence on earth formation, and current strong market acceptance. Disadvantages include many moving parts, difficulty with lost circulation material (LCM) usage, generally slower baud rates, narrower bandwidth, and incompatibility with air/underbalanced drilling which is a growing market in North America. The latter is an issue as the signals are substantially degraded if the drilling fluid inside the drill pipe contains substantial quantities of gas. MP telemetry also suffers when there are very low flow rates of mud, as low mud flow rates may result in too low a pressure differential to produce a strong enough signal at the surface. There are also a number of disadvantages of current MP generators, that include limited speed of response and recovery, jamming due to accumulation of debris which reduces the range of motion of the valve, failure of the bellows seal around the servo-valve activating shaft, failure of the rotary shaft seal, failure of drive shaft components, flow erosion, fatigue, and difficulty accesses and replacing small parts.

SUMMARY

According to one aspect of the present disclosure, there is provided a fluid pressure pulse generator comprises a stator and a rotor. The stator comprises a stator body with a circular opening therethrough and the rotor comprises a circular rotor body rotatably received in the circular opening of the stator body. One of the stator body or the rotor body comprises one or more than one fluid opening for flow of fluid therethrough and the other of the stator body or the rotor body comprises one or more than one full flow chamber. The rotor is rotatable between a full flow configuration whereby the full flow chamber and the fluid opening align so that fluid flows from the full flow chamber through the fluid opening; and a reduced flow configuration whereby the full flow chamber and the fluid opening are not aligned. The flow of fluid through the fluid opening in the reduced flow configuration is less than the flow of fluid through the fluid opening in the full flow configuration thereby generating a first fluid pressure pulse.

The flow area of the full flow chamber may be substantially equal to a flow area of the fluid opening. A bottom surface of the full flow chamber may be angled in the fluid flow direction for smooth flow of fluid from the full flow chamber to the fluid opening. The full flow chamber may include a bypass channel for flow of fluid through the full flow chamber.

The rotor body may comprise the fluid opening and the fluid opening may be fluidly coupled to a curved depression on an external surface of the rotor body, whereby the curved depression is configured to direct fluid through the fluid opening. A channel may be provided in the external surface of the rotor body fluidly connecting the curved depression and the fluid opening. The curved depression may be sloped and increase in depth from an end furthest from the fluid opening to an end closest to the fluid opening. The curved depression may be shaped like a spoon head.

The rotor body may comprise a plurality of fluid openings with leg sections positioned therebetween with an edge of each leg section perpendicular to a direction of rotation of the rotor. A wall thickness of the edge of the leg section may be less than a wall thickness of a middle part of the leg section.

The stator body may comprise the full flow chamber and may further comprise one or more than one wall section on an internal surface of the stator body whereby the fluid opening of the rotor body aligns with the wall section in the reduced flow configuration. A portion of the full flow chamber may be positioned behind the wall section.

The fluid pressure pulse generator may further comprise one or more than one intermediate flow chamber with a flow area less than a flow area of the full flow chamber. The rotor may be rotatable to an intermediate flow configuration whereby the intermediate flow chamber and the fluid opening align so that fluid flows from the intermediate flow chamber through the fluid opening, and the flow of fluid through the fluid opening in the intermediate flow configuration is less than the flow of fluid through the fluid opening in the full flow configuration but more than the flow of fluid through the fluid opening in the reduced flow configuration thereby generating a second fluid pressure pulse which is reduced compared to the first fluid pressure pulse.

The flow area of the intermediate flow chamber may be less than the flow area of the fluid opening. A bottom surface of the intermediate flow chamber may be angled in the fluid flow direction for smooth flow of fluid from the intermediate flow chamber to the fluid opening. The intermediate flow chamber may include a bypass channel for flow of fluid through the intermediate flow chamber.

According to another aspect of the present disclosure, there is provided a fluid pressure pulse generator system comprising a stator, a first rotor and a second rotor. The stator comprises a stator body with a circular opening therethrough and one or more than one full flow chamber. The first rotor comprises a first circular rotor body rotatably receivable in the circular opening of the stator body and the first rotor body comprises one or more than one first fluid opening for flow of fluid therethrough. The second rotor comprises a second circular rotor body rotatably receivable in the circular opening of the stator body and the second rotor body comprises one or more than one second fluid opening for flow of fluid therethrough. A flow area of the second fluid opening is less than a flow area of the first fluid opening. The first and second rotors are rotatable between:

(i) a full flow configuration whereby the full flow chamber and the first or second fluid opening align so that fluid flows from the full flow chamber through the first or second fluid opening; and (ii) a reduced flow configuration whereby the full flow chamber and the first or second fluid opening are not aligned and the flow of fluid through the first or second fluid opening is less than the flow of fluid through the first or second fluid opening in the full flow configuration thereby generating a first fluid pressure pulse.

The stator may further comprise one or more than one intermediate flow chamber with a flow area less than a flow area of the full flow chamber. The first and second rotors are rotatable to an intermediate flow configuration whereby the intermediate flow chamber and the first or second fluid opening align so that fluid flows from the intermediate flow chamber through the first or second fluid opening. The flow of fluid through the first or second fluid opening in the intermediate flow configuration is less than the flow of fluid through the first or second fluid opening in the full flow configuration but more than the flow of fluid through the first or second fluid opening in the reduced flow configuration thereby generating a second fluid pressure pulse which is reduced compared to the first fluid pressure pulse.

A bottom surface of the intermediate flow chamber may be angled in the fluid flow direction for smooth flow of fluid from the intermediate flow chamber to the first or second fluid opening. Alternatively or additionally, a bottom surface of the full flow chamber may be angled in the fluid flow direction for smooth flow of fluid from the full flow chamber to the first or second fluid opening. The intermediate flow chamber may include a bypass channel for flow of fluid through the intermediate flow chamber.

The first fluid opening may be fluidly coupled to a first curved depression on an external surface of the first rotor body whereby the first curved depression is configured to direct fluid through the first fluid opening. The second fluid opening may be fluidly coupled to a second curved depression on an external surface of the second rotor body whereby the second curved depression is configured to direct fluid through the second fluid opening. A flow area of the second curved depression may be less than a flow area of the first curved depression. The first curved depression may be sloped and increases in depth from an end furthest from the first fluid opening to an end closest to the first fluid opening. The second curved depression may be sloped and increases in depth from an end furthest from the second fluid opening to an end closest to the second fluid opening. The depth of the first curved depression may be greater than the depth of the second curved depression. The first and second curved depressions may be shaped like a spoon head.

The first rotor body may include a first channel in the external surface of the first rotor body fluidly connecting the first curved depression and the first fluid opening. The second rotor body may include a second channel in the external surface of the second rotor body fluidly connecting the second curved depression and the second fluid opening. A flow area of the second channel may be less than a flow area of the first channel.

The first rotor body may comprise a plurality of first fluid openings with leg sections positioned therebetween and the second rotor body may comprise a plurality of second fluid openings with leg sections positioned therebetween with an edge of each leg section perpendicular to a direction of rotation of the first or second rotor. A wall thickness of the edge of the leg section may be less than a wall thickness of a middle part of the leg section.

The stator body may comprise one or more than one wall section on an internal surface of the stator body whereby the first or second fluid openings align with the wall section in the reduced flow configuration. A portion of the full flow chamber may be positioned behind the wall section. The full flow chamber may include a bypass channel for flow of fluid through the full flow chamber.

According to a further aspect of the present disclosure, there is provided a dual flow fluid pressure pulse generator comprising a stator and a rotor. The stator comprises a stator body with a circular opening therethrough and the rotor comprising a circular rotor body rotatably received in the circular opening of the stator body. One of the stator body or the rotor body comprises one or more than one low flow fluid opening and one or more than one high flow fluid opening for flow of fluid therethrough and the other of the stator body or the rotor body comprises one or more than one full flow chamber. A flow area of the low flow fluid opening is less than a flow area of the high flow fluid opening. The rotor is rotatable between:

(i) a high flow mode full flow configuration whereby the full flow chamber and the high flow fluid opening align so that fluid flows from the full flow chamber through the high flow fluid opening;

(ii) a high flow mode reduced flow configuration whereby the full flow chamber and the high flow fluid opening are not aligned and the flow of fluid through the high flow fluid opening is less than the flow of fluid through the high flow fluid opening in the high flow mode full flow configuration thereby generating a first high flow fluid pressure pulse;

(iii) a low flow mode full flow configuration whereby the full flow chamber and the low flow fluid opening align so that fluid flows from the full flow chamber through the low flow fluid opening; and (iv) a low flow mode reduced flow configuration whereby the full flow chamber and the low flow fluid opening are not aligned and the flow of fluid through the low flow fluid opening is less than the flow of fluid through the low flow fluid opening in the low flow mode full flow configuration thereby generating a first low flow fluid pressure pulse.

The rotor body may comprise the low flow and high flow fluid openings. The high flow fluid opening may be fluidly coupled to a high flow curved depression on an external surface of the rotor body whereby the high flow curved depression is configured to direct fluid through the high flow fluid opening. The low flow fluid opening may be fluidly coupled to low flow curved depression on an external surface of the rotor body whereby the low flow curved depression is configured to direct fluid through the low flow fluid opening. A flow area of the low flow curved depression may be less than a flow area of the high flow curved depression.

A high flow channel may be provided in the external surface of the rotor body fluidly connecting the high flow curved depression and the high flow fluid opening. A low flow channel may be provided in the external surface of the rotor body fluidly connecting the low flow curved depression and the low flow fluid opening. A flow area of the low flow channel may be less than a flow area of the high flow channel.

The high flow curved depression may be sloped and increase in depth from an end furthest from the high flow fluid opening to an end closest to the high flow fluid opening. The low flow curved depression may be sloped and increase in depth from an end furthest from the low flow fluid opening to an end closest to the low flow fluid opening. The depth of the high flow curved depression may be greater than the depth of the low flow curved depression. The high flow and low flow curved depressions may be shaped like a spoon head.

Leg sections may be positioned between the high flow and low flow fluid openings with an edge of each leg section perpendicular to a direction of rotation of the rotor. A wall thickness of the edge of the leg section may be less than a wall thickness of a middle part of the leg section.

The stator body may comprise the full flow chamber and may further comprise one or more than one wall section on an internal surface of the stator body whereby the high flow fluid opening aligns with the wall section in the high flow mode reduced flow configuration and the low flow fluid opening aligns with the wall section in the low flow mode reduced flow configuration. A portion of the full flow chamber may be positioned behind the wall section.

A bottom surface of the full flow chamber may be angled in the fluid flow direction for smooth flow of fluid from the full flow chamber to the high flow or low flow fluid opening. The full flow chamber may include a bypass channel for flow of fluid through the full flow chamber.

The dual flow fluid pressure pulse generator may further comprise a deactivation zone configured to: block flow of fluid through the low flow fluid opening when the rotor is positioned in the high flow mode full flow configuration or the high flow mode reduced flow configuration; and block flow of fluid through the high flow fluid opening when the rotor is positioned in the low flow mode full flow configuration or the low flow mode reduced flow configuration. The stator body may comprise the full flow chamber and the deactivation zone may comprise a curved internal wall of the stator body.

The dual flow fluid pressure pulse generator may further comprise one or more than one intermediate flow chamber with a flow area less than a flow area of the full flow chamber. The rotor may be rotatable between:

(v) a high flow mode intermediate flow configuration whereby the intermediate flow chamber and the high flow fluid opening align so that fluid flows from the intermediate flow chamber through the high flow fluid opening, and the flow of fluid through the high flow fluid opening in the high flow mode intermediate flow configuration is less than the flow of fluid through the high flow fluid opening in the high flow mode full flow configuration but more than the flow of fluid through the high flow fluid opening in the high flow mode reduced flow configuration thereby generating a second high flow fluid pressure pulse which is reduced compared to the first high flow fluid pressure pulse; and (vi) a low flow mode intermediate flow configuration whereby the intermediate flow chamber and the low flow fluid opening align so that fluid flows from the intermediate flow chamber through the low flow fluid opening, and the flow of fluid through the low flow fluid opening in the low flow mode intermediate flow configuration is less than the flow of fluid through the low flow fluid opening in the low flow mode full flow configuration but more than the flow of fluid through the low flow fluid opening in the low flow mode reduced flow configuration thereby generating a second low flow fluid pressure pulse which is reduced compared to the first low flow fluid pressure pulse.

A bottom surface of the intermediate flow chamber may be angled in the fluid flow direction for smooth flow of fluid from the intermediate flow chamber to the high flow or low flow fluid opening. The intermediate flow chamber may include a bypass channel for flow of fluid through the intermediate flow chamber.

According to a further aspect of the present disclosure, there is provided a stator for a fluid pressure pulse generator. The stator comprises a stator body with a circular opening therethrough configured to receive a circular rotor for rotation therein. The stator body comprises one or more than one full flow chamber configured to align with one or more than one fluid opening in the rotor such that there is flow of fluid from the full flow chamber through the fluid opening.

A bottom surface of the full flow chamber may be angled in the fluid flow direction for smooth flow of fluid from the full flow chamber to the fluid opening.

The stator may further comprise a wall section on an internal surface of the stator body configured to align with the fluid opening in the rotor. A portion of the full flow chamber may be positioned behind the wall section. The full flow chamber may include a bypass channel for flow of fluid through the full flow chamber.

The stator body may further comprise one or more than one intermediate flow chamber with a flow area less than a flow area of the full flow chamber and configured to align with the fluid opening in the rotor such that there is flow of fluid from the intermediate flow chamber through the fluid opening. A bottom surface of the intermediate flow chamber may be angled in the fluid flow direction for smooth flow of fluid from the intermediate flow chamber to the fluid opening. The intermediate flow chamber may include a bypass channel for flow of fluid through the intermediate flow chamber.

According to a further aspect of the present disclosure, there is provided a rotor for a fluid pressure pulse generator. The rotor comprises a circular body with a fluid opening therethrough and a curved depression on an external surface of the circular body fluidly coupled to the fluid opening. The curved depression is configured to direct fluid flowing along the external surface of the circular body through the fluid opening.

The curved depression may be sloped and increases in depth from an end furthest from the fluid opening to an end closest to the fluid opening. The curved depression may be shaped like a spoon head. The rotor may further comprise a channel in the external surface of the circular body fluidly connecting the curved depression and the fluid opening.

The circular body may comprise a plurality of fluid openings with leg sections positioned therebetween with an edge of each leg section perpendicular to a direction of rotation of the rotor. A wall thickness of the edge of the leg section may be less than a wall thickness of a middle part of the leg section.

According to a further aspect of the present disclosure, there is provided a rotor for a dual flow fluid pressure pulse generator. The rotor comprises a circular body with one or more than one low flow fluid opening and one or more than one high flow fluid opening for flow of fluid therethrough. A flow area of the low flow fluid opening is less than a flow area of the high flow fluid opening.

The high flow fluid opening may be fluidly coupled to a high flow curved depression on an external surface of the circular body whereby the high flow curved depression is configured to direct fluid through the high flow fluid opening. The low flow fluid opening may be fluidly coupled to low flow curved depression on an external surface of the circular body whereby the low flow curved depression is configured to direct fluid through the low flow fluid opening. A flow area of the low flow curved depression may be less than a flow area of the high flow curved depression. The high flow curved depression may be sloped and increase in depth from an end furthest from the high flow fluid opening to an end closest to the high flow fluid opening. The low flow curved depression may be sloped and increases in depth from an end furthest from the low flow fluid opening to an end closest to the low flow fluid opening. The depth of the high flow curved depression may be greater than the depth of the low flow curved depression. The high flow and low flow curved depressions may be shaped like a spoon head.

The rotor may further comprises a high flow channel in the external surface of the circular body fluidly connecting the high flow curved depression and the high flow fluid opening and a low flow channel in the external surface of the circular body fluidly connecting the low flow curved depression and the low flow fluid opening. A flow area of the low flow channel may be less than a flow area of the high flow channel.

The circular body may comprise leg sections positioned between the high flow and low flow fluid openings with an edge of each leg section perpendicular to a direction of rotation of the rotor. A wall thickness of the edge of the leg section may be less than a wall thickness of a middle part of the leg section.

According to a further aspect of the present disclosure, there is provided a measurement while drilling tool comprising a pulser assembly with a drive shaft and the rotor of the present disclosure fixed to the drive shaft for rotation thereby.

According to a further aspect of the present disclosure, there is provided a measurement while drilling tool system comprising the measurement while drilling tool and a plurality of stators of the present disclosure. The measurement while drilling tool comprises a pulser assembly with a drive shaft and the rotor of the present disclosure fixed to the drive shaft for rotation. The stator bodies of the plurality of stators have the same sized circular opening for receiving the circular body of the rotor and various different sized external dimensions to fit various different sized drill collars used for downhole drilling.

According to a further aspect of the present disclosure, there is provided a measurement while drilling tool system comprising the measurement while drilling tool and at least one single fluid pressure pulse generating stator and at least one dual fluid pressure pulse generating stator of the present disclosure.

According to a further aspect of the present disclosure, there is provided a measurement while drilling tool comprising the fluid pressure pulse generator of the present disclosure and a pulser assembly with a drive shaft. The rotor of the fluid pressure pulse generator is fixed to the drive shaft for rotation thereby.

According to a further aspect of the present disclosure, there is provided a measurement while drilling tool system comprising the fluid pressure pulse generator system of the present disclosure and a pulser assembly with a drive shaft. The first or second rotor of the fluid pressure pulse generator system is fixable to the drive shaft for rotation thereby.

According to a further aspect of the present disclosure, there is provided a measurement while drilling tool comprising the dual flow fluid pressure pulse generator of the present disclosure and a pulser assembly with a drive shaft. The rotor of the dual flow fluid pressure pulse generator is fixed to the drive shaft for rotation thereby.

According to a further aspect of the present disclosure, there is provided a method of generating a fluid pressure pulse pattern by rotating a rotor within a stator of a fluid pressure pulse generator, the fluid pressure pulse pattern comprising a first fluid pressure pulse and a second fluid pressure pulse. The method comprises:

(a) starting in a start position where there is flow of fluid through one or more than one fluid opening in the stator or rotor;

(b) rotating the rotor in one direction to a first position where the flow of fluid through the fluid opening is less than the flow of fluid through the fluid opening in the start position whereby the first fluid pressure pulse is generated; or rotating the rotor in an opposite direction to a second position where the flow of fluid through the fluid opening is less than the flow of fluid through the fluid opening in the start position whereby the second fluid pressure pulse is generated;

(c) rotating the rotor back to the start position;

(d) repeating steps (b) and (c) to generate the fluid pressure pulse pattern.

The flow of fluid through the fluid opening in the first and second position may be substantially the same such that the first and second fluid pressure pulse are substantially the same size. Alternatively, the flow of fluid through the fluid opening in the second position may be greater than the flow of fluid through the fluid opening in the first position such that the first fluid pressure pulse is larger than the second pressure fluid pressure pulse.

When the first fluid pressure pulse is larger than the second pressure fluid pressure pulse the stator may comprise a stator body with a circular opening therethrough and the rotor may comprise a circular rotor body rotatably received in the circular opening of the stator body, one of the stator body or the rotor body comprising the fluid opening and the other of the stator body or the rotor body comprising one or more than one full flow chamber and one or more than one intermediate flow chamber with a flow area less than a flow area of the full flow chamber. In the start position the full flow chamber and the fluid opening align so that fluid flows from the full flow chamber through the fluid opening, in the second position the intermediate flow chamber and the fluid opening align so that fluid flows from the intermediate flow chamber through the fluid opening, and in the first position the full flow chamber and the intermediate flow chamber are not aligned with the fluid opening so there is no flow of fluid from the full flow chamber or the intermediate flow chamber through the fluid opening.

When the first and second pressure pulses are substantially equal, the stator may comprise a stator body with a circular opening therethrough and the rotor may comprise a circular rotor body rotatably received in the circular opening of the stator body, one of the stator body or the rotor body comprising the fluid opening and the other of the stator body or the rotor body comprising one or more than one full flow chamber. In the start position the full flow chamber and the fluid opening align so that fluid flows from the full flow chamber through the fluid opening, and in the first and second positions the full flow chamber is not aligned with the fluid opening so there is no flow of fluid from the full flow chamber through the fluid opening.

DETAILED DESCRIPTION

The embodiments described herein generally relate to a fluid pressure pulse generator for generating pressure pulses in fluid. The fluid pressure pulse generator of the embodiments described herein may be used for mud pulse (MP) telemetry used in downhole drilling. The fluid pressure pulse generator may alternatively be used in other methods where it is necessary to generate a fluid pressure pulse.

Figure 1A:
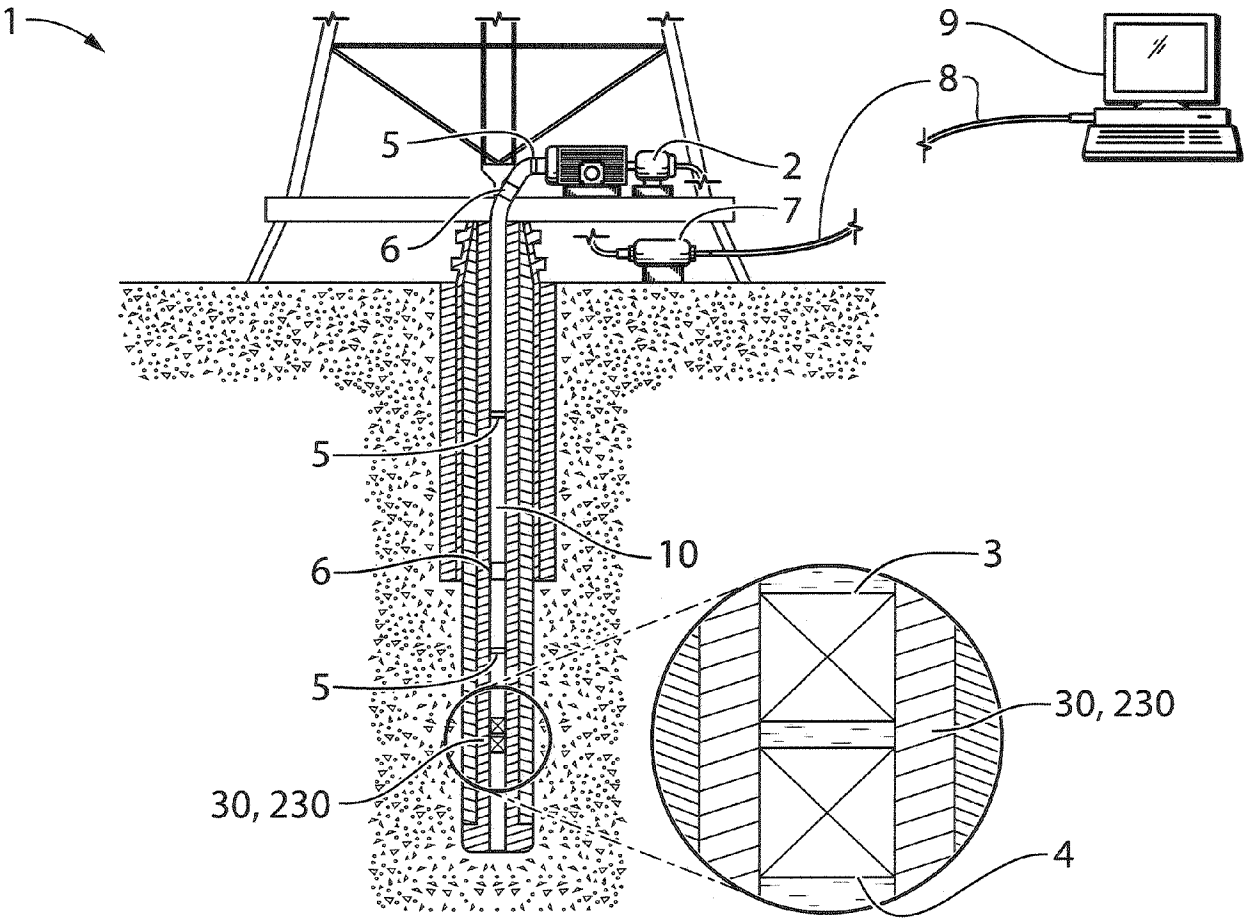
FIG. 1*a* is a schematic of a mud pulse (MP) telemetry method for downhole drilling employing a dual fluid pressure pulse generator that generates two different sized pressure pulses in accordance with embodiments of the invention.
Figure 1B:
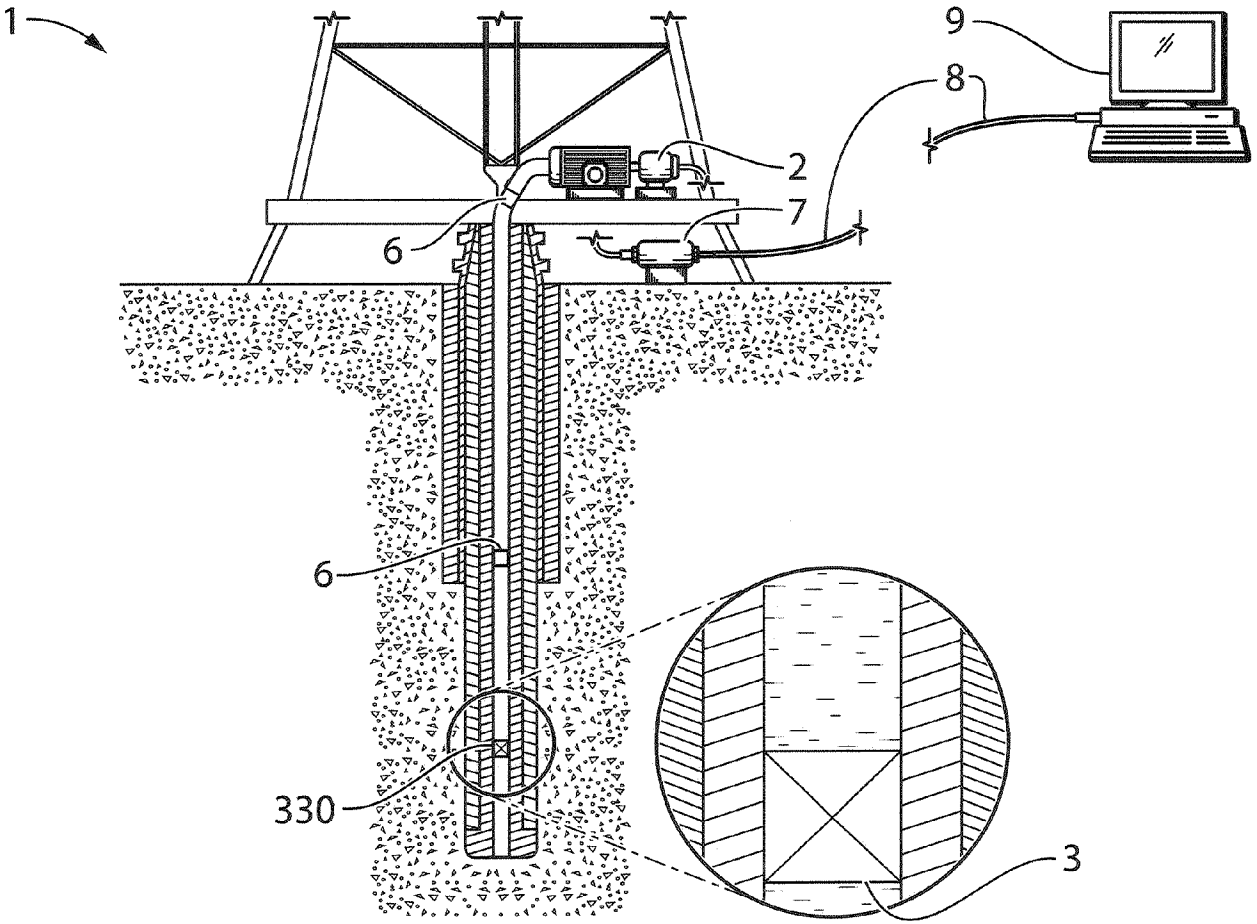
FIG. 1*b* is a schematic of a MP telemetry method for downhole drilling employing a single fluid pressure pulse generator that generates a single sized pressure pulse in accordance with embodiments of the invention.

Referring to the drawings and specifically to FIGS. 1*a* and 1*b*, there is shown a schematic representation of a MP telemetry method using the fluid pressure pulse generator embodiments of the invention. In downhole drilling equipment 1, drilling fluid or "mud" is pumped down a drill string by pump 2 and passes through a measurement while drilling (MWD) tool. The MWD tool includes a dual fluid pressure pulse generator 30, 230 or a single fluid pressure pulse generator 330. The dual and single fluid pressure pulse generators 30, 230, 330 each have a reduced flow configuration (schematically represented as valve 3) which generates a full positive pressure pulse (represented schematically as full pressure pulse 6) and a full flow configuration where no pressure pulse is generated. The dual fluid pressure pulse generator 30, 230 represented in FIG. 1*a* also has an intermediate flow configuration (schematically represented as valve 4) which generates an intermediate positive pressure pulse (represented schematically as intermediate pressure pulse 5). Intermediate pressure pulse 5 is reduced compared to the full pressure pulse 6.

Information acquired by downhole sensors (not shown) is transmitted in specific time divisions by the pressure pulses 5, 6 in mud column 10. More specifically, signals from sensor modules (not shown) are received and processed in a data encoder in a bottom hole assembly (not shown) where the data is digitally encoded as is well established in the art. A controller then actuates the dual fluid pressure pulse generator 30, 230 to generate pressure pulses 5, 6 or the single fluid pressure pulse generator 330 to generate pressure pulse 6. Pressure pulses 5, 6 containing the encoded data are transmitted to the surface and detected by a pressure transducer 7. The measured pressure pulses are transmitted as electrical signals through transducer cable 8 to a surface computer 9 which decodes and displays the transmitted information to the drilling operator.

As is known in the art, the three key parameters of a periodic waveform (pressure pulses 5, 6) are its amplitude ("volume"), its phase ("timing") and its frequency ("pitch"). Any of these properties can be modified in accordance with a low frequency signal to obtain the modulated signal. Frequency-shift keying (FSK) is a frequency modulation scheme in which digital information is transmitted through discrete frequency changes of a carrier wave. The simplest FSK is binary FSK (BFSK). BFSK uses a pair of discrete frequencies to transmit binary (0s and 1s) information. Amplitude shift keying (ASK) conveys data by changing the amplitude of the carrier wave. Phase-shift keying (PSK) conveys data by changing, or modulating, the phase of a reference signal (the carrier wave). It is known to combine different modulation techniques.

The ability of the dual fluid pressure pulse generator 30, 230 to produce two different sized pressure pulses 5, 6, allows for greater amplitude variation in the binary data produced for ASK modulation. The frequency of pulses 6 produced by the single pulse fluid pressure generator 330 can be varied for FSK modulation. Although the single pulse fluid pressure generator 330 can be used universally for downhole drilling, generation of single binary sized pressure pulse 6 may specifically be required when there is very low fluid flow or for deep zone drilling, to ensure that the pulse signal is strong enough to be detected on the surface.

One or more signal processing techniques are used to separate undesired mud pump noise, rig noise or downward propagating noise from upward MWD signals. The data transmission rate is governed by Lamb's theory for acoustic waves in a drilling mud and is about 1.1 to 1.5 km/s. The fluid pressure pulse generator 30, 230, 330 must operate in an unfriendly environment under high static downhole pressures, high temperatures, high flow rates and various erosive flow types. The fluid pressure pulse generator 30, 230, 330 typically operates in a flow rate as dictated by the size of the drill pipe bore, and limited by surface pumps, drill bit total flow area (TFA), and mud motor/turbine differential requirements for drill bit rotation. The pulses generated by the fluid pressure pulse generator 30, 230, 330 may be between 100-500 psi, depending on flow rate and density.

Figure 2:
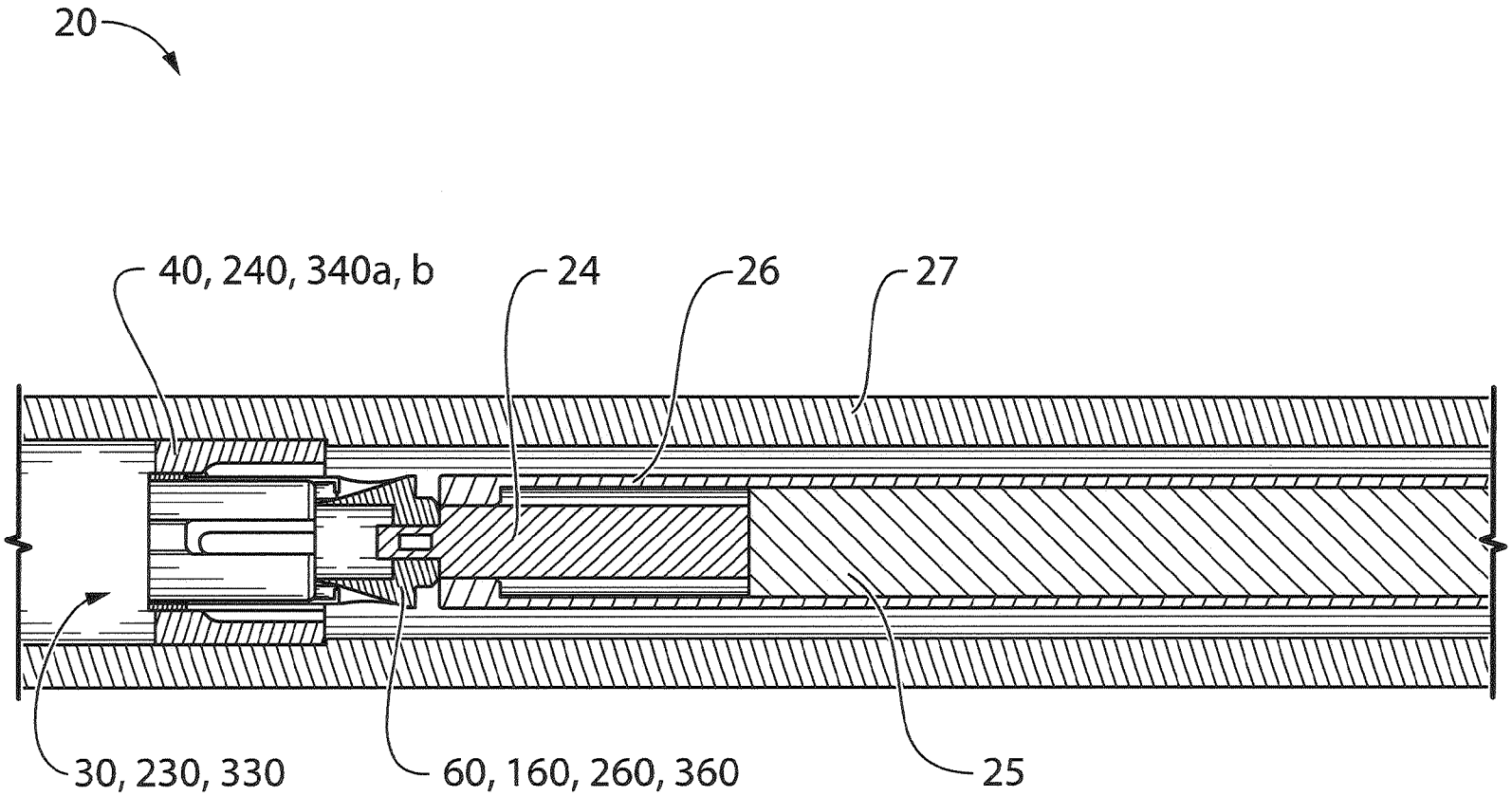
FIG. 2 is a schematic of a measurement while drilling (MWD) tool incorporating a dual or single fluid pressure pulse generator in accordance with embodiments of the invention.

Referring to FIG. 2, there is shown a MWD tool 20 incorporating the fluid pressure pulse generator 30, 230, 330 comprising a stator 40, 240, 340*a,b* and a rotor 60, 160, 260, 360 in accordance with embodiments of the invention. The stator 40, 240, 340*a,b* is fixed to a landing sub 27 and the rotor 60, 160, 260, 360 is fixed to a drive shaft 24 of a pulser assembly 26. The pulser assembly 26 includes a sub assembly 25 which houses downhole sensors, control electronics, a motor, gearbox, and other equipment (not shown) required by the MWD tool to sense downhole information and rotate the drive shaft 24 and thereby rotate the rotor 60, 160, 260, 360 in a controlled pattern to generate pressure pulses 5, 6. The fluid pressure pulse generator 30, 230, 330 is generally located at the downhole end of the MWD tool 20. Drilling fluid pumped from the surface by pump 2 flows between the outer surface of the pulser assembly 26 and the inner surface of the landing sub 27. When the fluid reaches the fluid pressure pulse generator 30, 230, 330 it is diverted through fluid openings 67, 167, 267*a*, 267*b*, 367 in the rotor 60, 160, 260, 360 and exits the internal area of the rotor as will be described in more detail below with reference to FIGS. 3 to 17 and 19 to 22. In different configurations of the rotor/stator combination, the fluid flow area varies, thereby creating positive pressure pulses 5, 6 that are transmitted to the surface as will be described in more detail below.

Dual Fluid Pressure Pulse Generator

Figure 5:
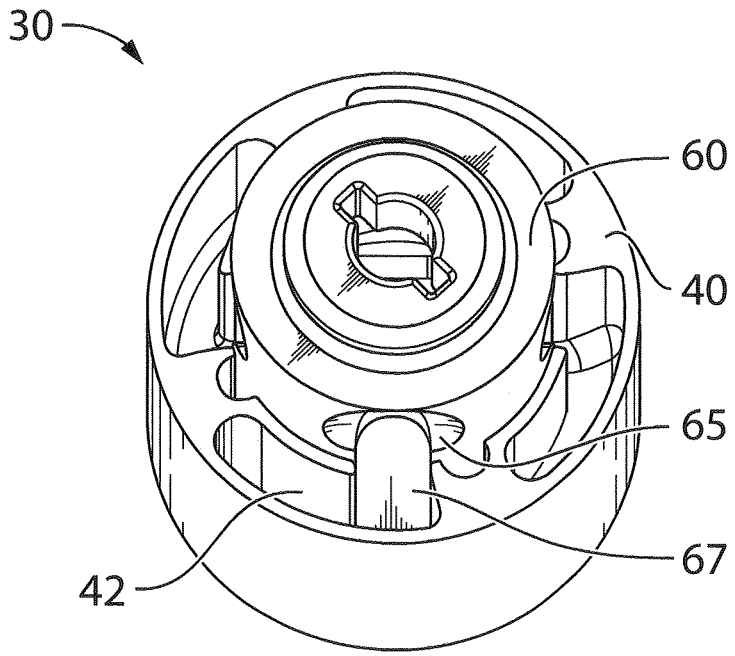
FIG. 5 is a perspective view of the rotor/stator combination of the dual fluid pressure pulse generator of the first embodiment in full flow configuration.
Figure 6:
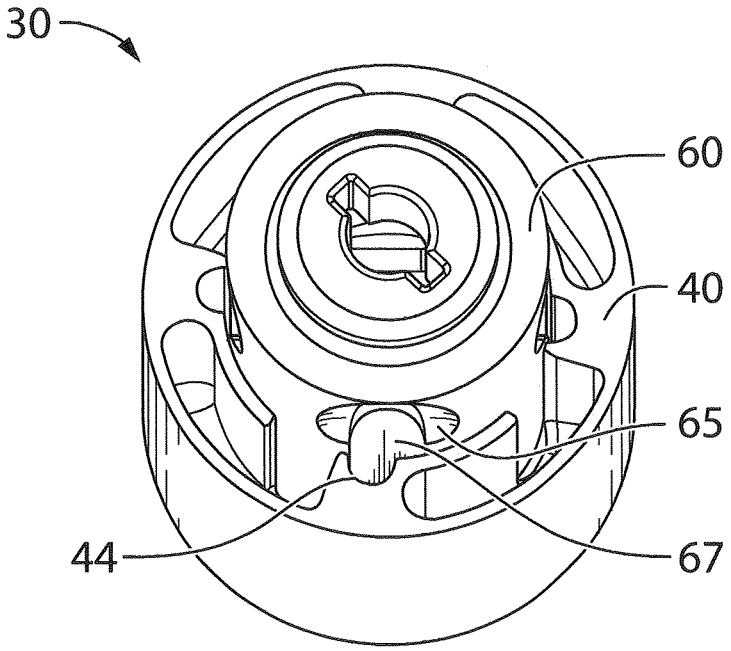
FIG. 6 is a perspective view of the rotor/stator combination of the dual fluid pressure pulse generator of the first embodiment in intermediate flow configuration.
Figure 7:
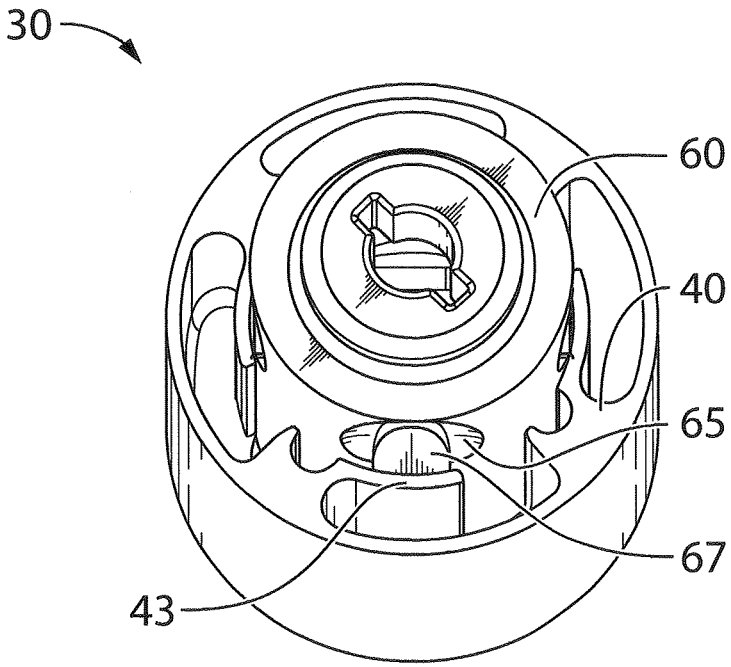
FIG. 7 is a perspective view of the rotor/stator combination of the dual fluid pressure pulse generator of the first embodiment in reduced flow configuration.

Referring now to FIGS. 3 to 7, there is shown the dual pulse stator 40 and rotor 60 which combine to form a dual fluid pressure pulse generator 30 according to a first embodiment. The rotor 60 comprises a circular body 61 having an uphole end 68 with a drive shaft receptacle 62 and a downhole opening 69. The drive shaft receptacle 62 is configured to receive and fixedly connect with the drive shaft 24 of the pulser assembly 26, such that in use the rotor 60 is rotated by the drive shaft 24. The stator 40 comprises a stator body 41 with a circular opening 47 therethrough sized to receive the circular body 61 of the rotor as shown in FIGS. 5 to 7. The stator body 41 may be annular or ring shaped as shown in the embodiment of FIGS. 3 to 7, to enable it to fit within a drill collar of a downhole drill string, however in alternative embodiments (not shown) the stator body may be a different shape, for example square shaped, rectangular shaped, or oval shaped depending on the fluid pressure pulse operation it is being used for.

The stator 40 and rotor 60 are made up of minimal parts and their configuration beneficially provides easy line up and fitting of the rotor 60 within the stator 40. There is no positioning or height requirement and no need for an axial gap between the stator 40 and the rotor 60 as is required with known rotating disc valve pulsers. It is therefore not necessary for a skilled technician to be involved with set up of the fluid pressure pulse generator 30 and the operator can easily change or service the stator/rotor combination if flow rate conditions change or there is damage to the rotor 60 or stator 40 during operation.

The circular body 61 of the rotor has four rectangular fluid openings 67 separated by four leg sections 70 and a mud lubricated journal bearing ring section 64 defining the downhole opening 69. The bearing ring section 64 helps centralize the rotor 60 in the stator 40 and provides structural strength to the leg sections 70. The circular body 61 also includes four depressions 65 that are shaped like the head of a spoon on an external surface of the circular body 61. Each spoon shaped depression 65 is connected to one of the fluid openings 67 by a flow channel 66 on the external surface of the body 61. Each connected spoon shaped depression 65, flow channel 66 and fluid opening 67 forms a fluid diverter and there are four fluid diverters positioned equidistance circumferentially around the circular body 61.

The spoon shaped depressions 65 and flow channels 66 direct fluid flowing in a downhole direction external to the circular body 61, through the fluid openings 67, into a hollow internal area 63 of the body, and out of the downhole opening 69. The spoon shaped depressions 65 gently slopes, with the depth of the depression increasing from the uphole end to the downhole end of the depression ensuring that the axial flow path or radial diversion of the fluid is gradual with no sharp turns. This is in contrast to the stator/rotor combination described in U.S. Pat. No. 8,251,160, where windows in the stator and the rotor align to create a fluid flow path orthogonal to the windows through the rotor and stator. The depth of the spoon shaped depressions 65 can vary depending on flow parameter requirements.

The spoon shaped depressions 65 act as a nozzle to aid fluid flow. Without being bound by science, it is thought that the nozzle design results in increased volume of fluid flowing through the fluid opening 67 compared to an equivalent fluid diverter without the nozzle design, such as the window fluid opening of the rotor/stator combination described in U.S. Pat. No. 8,251,160. Curved edges 71 of the spoon shaped depressions 65 also provide less resistance to fluid flow and reduction of pressure losses across the rotor/stator as a result of optimal fluid geometry. Furthermore, the curved edges 71 of the spoon shaped depressions 65 have a reduced surface compared to, for example, a channel having the same flow area as the spoon shaped depression 65. This means that the surface area of the curved edges 71 cutting through fluid when the rotor is rotated is small, thereby reducing the force required to turn the rotor and reducing the motor torque requirement. By reducing the motor torque requirement, there is beneficially a reduction in battery consumption and less wear on the motor, beneficially reducing costs.

Motor torque requirement is also reduced by reducing the surface area of edges 72 of each leg section 70 which are perpendicular to the direction of rotation. Edges 72 cut through the fluid during rotation of the rotor 60 and therefore beneficially have as small a surface area as possible whilst still maintaining structural stability of the leg sections 70. To increase structural stability of the leg sections 70, the thickness at the middle of the leg section 70 furthest from the edges 72 may be greater than the thickness at the edges 72, although the wall thickness of each leg section 70 may be the same throughout. In addition, the bearing ring section 64 of the circular body 61 provides structural stability to the leg sections 70.

In alternative embodiments (not shown) a different curved shaped depression other than the spoon shaped depression may be utilized on the external surface of the rotor, for example, but not limited to, egg shaped, oval shaped, arc shaped, or circular shaped. Furthermore, the flow channel 66 need not be present and the fluid openings 67 may be any shape that allows flow of fluid from the external surface of the rotor through the fluid openings 67 to the hollow internal area 63.

The stator body 41 includes four full flow chambers 42, four intermediate flow chambers 44 and four walled sections 43 in alternating arrangement around the stator body 41. In the embodiment shown in FIGS. 3 to 7, the four full flow chambers 42 are L shaped and the four intermediate flow chambers 44 are U shaped, however in alternative embodiments (not shown) other configurations may be used for the chambers 42, 44. The geometry of the chambers is not critical provided the flow area of the chambers is conducive to generating the intermediate pulse 5 and no pulse in different flow configurations as described below in more detail. A bearing ring section 46 at the downhole end of the stator body 41 helps centralize the rotor 60 in the stator 40 and reduces flow of fluid between the external surface of the rotor 60 and the internal surface of the stator 40. Four flow sections are positioned equidistance around the circumference of the stator 40, with each flow section having one of the intermediate flow chambers 44, one of the full flow chambers 42, and one of the wall sections 43. The full flow chamber 42 of each flow section is positioned between the intermediate flow chamber 44 and the walled section 43. In the embodiment shown in FIG. 3*b*, each full flow chamber 42 includes a bypass channel 49 at the downhole end thereof. The bypass channel 49 allows some drilling fluid to flow through the full flow chamber at all times as will be discussed below in more detail.

In use, each of the four flow sections of the stator 40 interact with one of the four fluid diverters of the rotor 60. The rotor 60 is rotated in the fixed stator 40 to provide three different flow configurations as follows:

1. Full flow—where the rotor fluid openings 67 align with the stator full flow chambers 42, as shown in FIG. 5;
2. Intermediate flow—where the rotor fluid openings 67 align with the stator intermediate flow chambers 44, as shown in FIG. 6; and
3. Reduced flow—where the rotor fluid openings 67 align with the stator walled sections 43, as shown in FIG. 7.

In the full flow configuration shown in FIG. 5, the stator full flow chambers 42 align with the fluid openings 67 and flow channels 66 of the rotor, so that fluid flows from the full flow chambers 42 through the fluid openings 67. The flow area of the full flow chambers 42 may correspond to the flow area of the rotor fluid openings 67. This corresponding sizing beneficially leads to no or minimal resistance in flow of fluid through the fluid openings 67 when the rotor is positioned in the full flow configuration. There is minimal pressure increase and no pressure pulse is generated in the full flow configuration. The L shaped configuration of the chambers 42 reduces space requirement as each L shaped chamber tucks behind one of the walled sections 43 allowing for a compact stator design, which beneficially reduces production costs and results in less likelihood of blockage.

When the rotor is positioned in the reduced flow configuration as shown in FIG. 7, the walled section 43 aligns with the fluid openings 67 and flow channels 66 of the rotor. Fluid is still diverted by the spoon shaped depressions 65 along the flow channels 66 and through the fluid openings 67, and also in the embodiment of FIG. 3*b* fluid flows through the bypass channels 49; however, the total overall flow area is reduced compared to the total overall flow area in the full flow configuration. The fluid pressure therefore increases to generate the full pressure pulse 6.

In the intermediate flow configuration as shown in FIG. 6, the intermediate flow chambers 44 align with the fluid openings 67 and flow channels 66 of the rotor, so that fluid flows from the intermediate flow chambers 44 through the fluid openings 67. The flow area of the intermediate flow chambers 44 is less than the flow area of the full flow chambers 42, therefore, the total overall flow area in the intermediate flow configuration is less than the total overall flow area in the full flow configuration, but more than the total overall flow area in the reduced flow configuration. As a result, the flow of fluid through the fluid openings 67 in the intermediate flow configuration is less than the flow of fluid through the fluid openings 67 in the full flow configuration, but more than the flow of fluid through the fluid openings 67 in the reduced flow configuration. The intermediate pressure pulse 5 is therefore generated which is reduced compared to the full pressure pulse 6. The flow area of the intermediate flow chambers 44 may be one half, one third, one quarter the flow area of the full flow chambers 42, or any amount that is less than the flow area of the full flow chambers 42 to generate the intermediate pressure pulse 5 and allow for differentiation between pressure pulse 5 and pressure pulse 6.

When the rotor 60 is positioned in the reduced flow configuration as shown in FIG. 7, fluid is still diverted by the spoon shaped depressions 65 along the flow channels 66 and through the fluid openings 67 otherwise the pressure build up would be detrimental to operation of the downhole drilling. In the embodiment shown in FIG. 3*b*, fluid also flows through the bypass channels 49 in the reduced flow configuration. As the flow of fluid through the bypass channels 49 is relatively constant in the full flow, reduced flow and intermediate flow configurations, flow of fluid through the bypass channels 49 does not affect generation of the dual pressure pulses 5, 6. A stator 40 incorporating the bypass channels 49 as shown in FIG. 3*b* may be utilized in high fluid flow conditions when the fluid pressure in the reduced flow configuration would be too high if fluid was only being diverted by the spoon shaped depressions 65 through the fluid openings 67 in the rotor 60. The bypass channels 49 may also beneficially reduce or prevent cavitation in the full flow chambers 42 especially when subjected to higher fluid pressure such as in deep downhole environments. More specifically, cavitation is the formation of vapour cavities in a liquid. When subjected to higher pressure such as in deep downhole environments, the vapour cavities implode and can generate an intense shockwave which could cause fatigue and wear of the stator and/or rotor. The bypass channels 49 allow some flow of fluid through the full flow chambers 42 at all times prevented fluid collecting in the full flow chamber 42 thereby reducing the likelihood of vapour cavities forming and imploding. In alternative embodiments (not shown), bypass channels may be included in the intermediate flow chambers 44 in addition to, or alternative to, the full flow chamber bypass channels 49.

In contrast to the rotor/stator combination disclosed in U.S. Pat. No. 8,251,160, where the constant flow of fluid is through a plurality of circular holes in the stator, in the present embodiments, the constant flow of fluid is through the rotor fluid openings 67 and optionally the bypass channels 42. This beneficially reduces the likelihood of blockages and also allows for a more compact stator design.

Figure 3A:
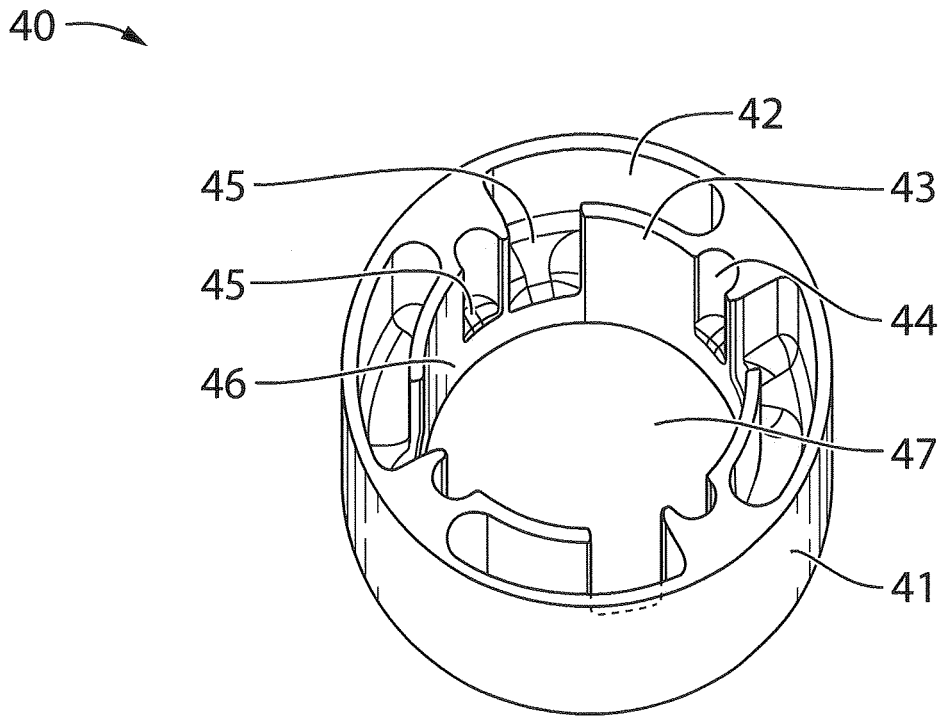
FIG. 3*a* is a perspective view of one embodiment of a stator of a dual fluid pressure pulse generator according to a first embodiment.
Figure 3B:
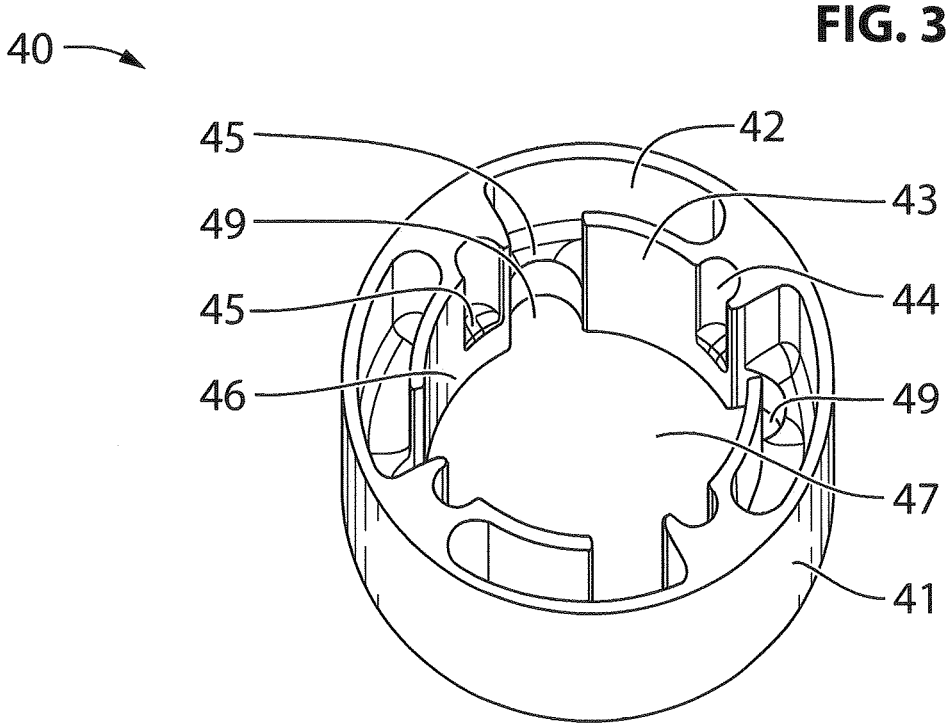
FIG. 3*b* is a perspective view of another embodiment of a stator of a dual fluid pressure pulse generator according to a first embodiment.
Figure 4:
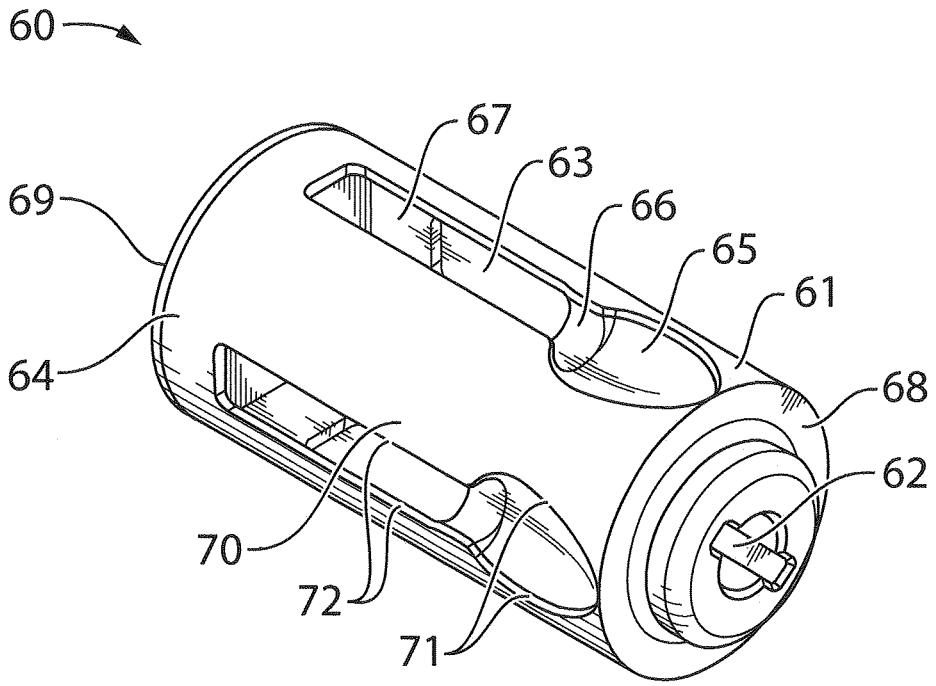
FIG. 4 is a perspective view of a first embodiment of a rotor of the dual fluid pressure pulse generator of the first embodiment.

In the embodiments of the stator 40 shown in FIGS. 3*a* and 3*b* a bottom face surface 45 of both the full flow chambers 42 and the intermediate flow chambers 44 of the stator 40 is angled in the downhole flow direction for smooth flow of fluid from chambers 42, 44 through the rotor fluid openings 67 in the full flow and intermediate flow configurations respectively, thereby reducing flow turbulence. In all three flow configurations the full flow chambers 42 and the intermediate flow chambers 44 are filled with fluid, however fluid flow from the chambers 42, 44 will be restricted unless the rotor fluid openings 67 are aligned with the full flow chambers 42 or intermediate flow chambers 44 in the full flow and intermediate flow configurations respectively.

A combination of the spoon shaped depressions 65 and flow channels 66 of the rotor 60 and the angled bottom face surface 45 of the chambers 42, 44 of the stator provide a smooth fluid flow path with no sharp angles or bends. The smooth fluid flow path beneficially minimizing abrasion and wear on the pulser assembly 26.

Provision of the intermediate flow configuration allows the operator to choose whether to use the reduced flow configuration, intermediate flow configuration or both configurations to generate pressure pulses depending on fluid flow conditions. The fluid pressure pulse generator 30 can operate in a number of different flow conditions. For higher fluid flow rate conditions, the pressure generated using the reduced flow configuration may be too great and cause damage to the system. The operator may therefore choose to only use the intermediate flow configuration to produce detectable pressure pulses at the surface. For lower fluid flow rate conditions, the pressure pulse generated in the intermediate flow configuration may be too low to be detectable at the surface. The operator may therefore choose to operate using only the reduced flow configuration to produce detectable pressure pulses at the surface. Thus it is possible for the downhole drilling operation to continue when the fluid flow conditions change without having to change the fluid pressure pulse generator 30. For normal fluid flow conditions, the operator may choose to use both the reduced flow configuration and the intermediate flow configuration to produce two distinguishable pressure pulses 5, 6, at the surface and increase the data rate of the fluid pressure pulse generator 30.

If one of the stator chambers (either full flow chambers 42 or intermediate flow chambers 44) is blocked or damaged, or one of the stator wall sections 43 is damaged, operations can continue, albeit at reduced efficiency, until a convenient time for maintenance. For example, if one or more of the stator wall sections 43 is damaged, the full pressure pulse 6 will be affected; however operation may continue using the intermediate flow configuration to generate intermediate pressure pulse 5. Alternatively, if one or more of the intermediate flow chambers 44 is damaged or blocked, the intermediate pulse 5 will be affected; however operation may continue using the reduced flow configuration to generate the full pressure pulse 6. If one or more of the full flow chambers 42 is damaged or blocked, operation may continue by rotating the rotor between the reduced flow configuration and the intermediate flow configuration. Although there will be no zero (minimal) pressure state, there will still be a pressure differential between the full pressure pulse 6 and the intermediate pressure pulse 5 which can be detected and decoded on the surface until the stator can be serviced. Furthermore, if one or more of the rotor fluid openings 67 is damaged or blocked which results in one of the flow configurations not being usable, the other two flow configurations can be used to produce a detectable pressure differential. For example, damage to one of the rotor fluid openings 67 may result in an increase in fluid flow through the rotor such that the intermediate flow configuration and the full flow configuration do not produce a detectable pressure differential, and the reduced flow configuration will need to be used to get a detectable pressure pulse.

Provision of multiple rotor fluid openings 67 and multiple stator chambers 42, 44 and wall sections 43, provides redundancy and allows the fluid pressure pulse generator 30 to continue working when there is damage or blockage to one of the rotor fluid openings 67 and/or one of the stator chambers 42, 44 or wall sections 43. Cumulative flow of fluid through the remaining undamaged or unblocked rotor fluid openings 67 and stator chambers 42, 44 still results in generation of detectable full or intermediate pressure pulses 5, 6, even though the pulse heights may not be the same as when there is no damage or blockage.

It is evident from the foregoing that while the embodiments shown in FIGS. 3 to 7 utilize four fluid openings 67 together with four full flow chambers 42, four intermediate flow chambers 44 and four wall sections 43 in the stator, different numbers of rotor fluid openings 67, stator flow chambers 42, 44 and stator wall sections 43 may be used. Provision of more fluid openings 67, chambers 42, 44 and wall section 43 beneficially reduces the amount of rotor rotation required to move between the different flow configurations, however, too many openings 67, chambers 42, 44 and wall section 43 decreases the stability of the rotor and/or stator and may result in a less compact design thereby increasing production costs. Furthermore, the number of rotor fluid openings 67 need not match the number of stator flow chambers 42, 44 and stator wall sections 43. Different combinations may be utilized according to specific operation requirements of the fluid pressure pulse generator. In alternative embodiments there may be additional intermediate flow chambers present that have a flow area less than the flow area of full flow chambers 42. The flow area of the additional intermediate flow chambers may vary to produce additional intermediate pressure pulses that are different in size to intermediate pressure pulse 5 and thereby increase the data rate of the fluid pressure pulse generator 30. The innovative aspects apply equally in embodiments such as these.

It is also evident from the foregoing that while the embodiments shown in FIGS. 3 to 7 utilize fluid openings in the rotor and flow chambers in the stator, in alternative embodiments (not shown) the fluid openings may be positioned in the stator and the flow chambers may be present in the rotor. In these alternative embodiments the rotor still rotates between full flow, intermediate flow and reduced flow configurations whereby the fluid openings in the stator align with full flow chambers, intermediate flow chambers and wall sections of the rotor respectively. The innovative aspects apply equally in embodiments such as these.

Low Flow Rotor

Figure 8:
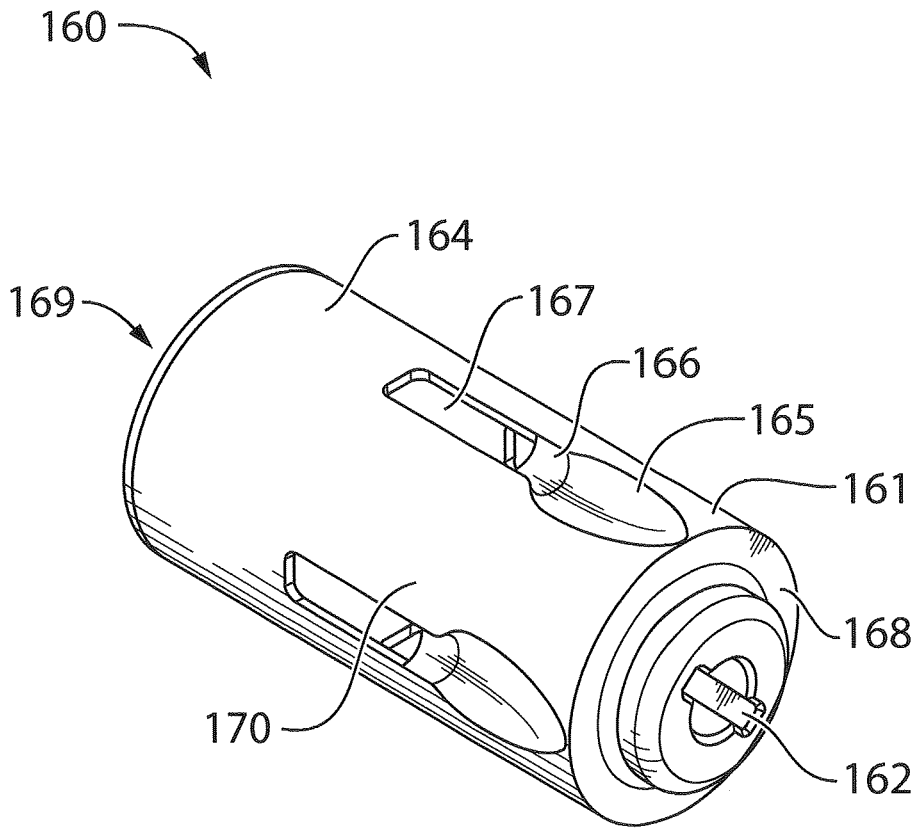
FIG. 8 is a perspective view of a second embodiment of the rotor of the dual fluid pressure pulse generator of the first embodiment.
Figure 9:
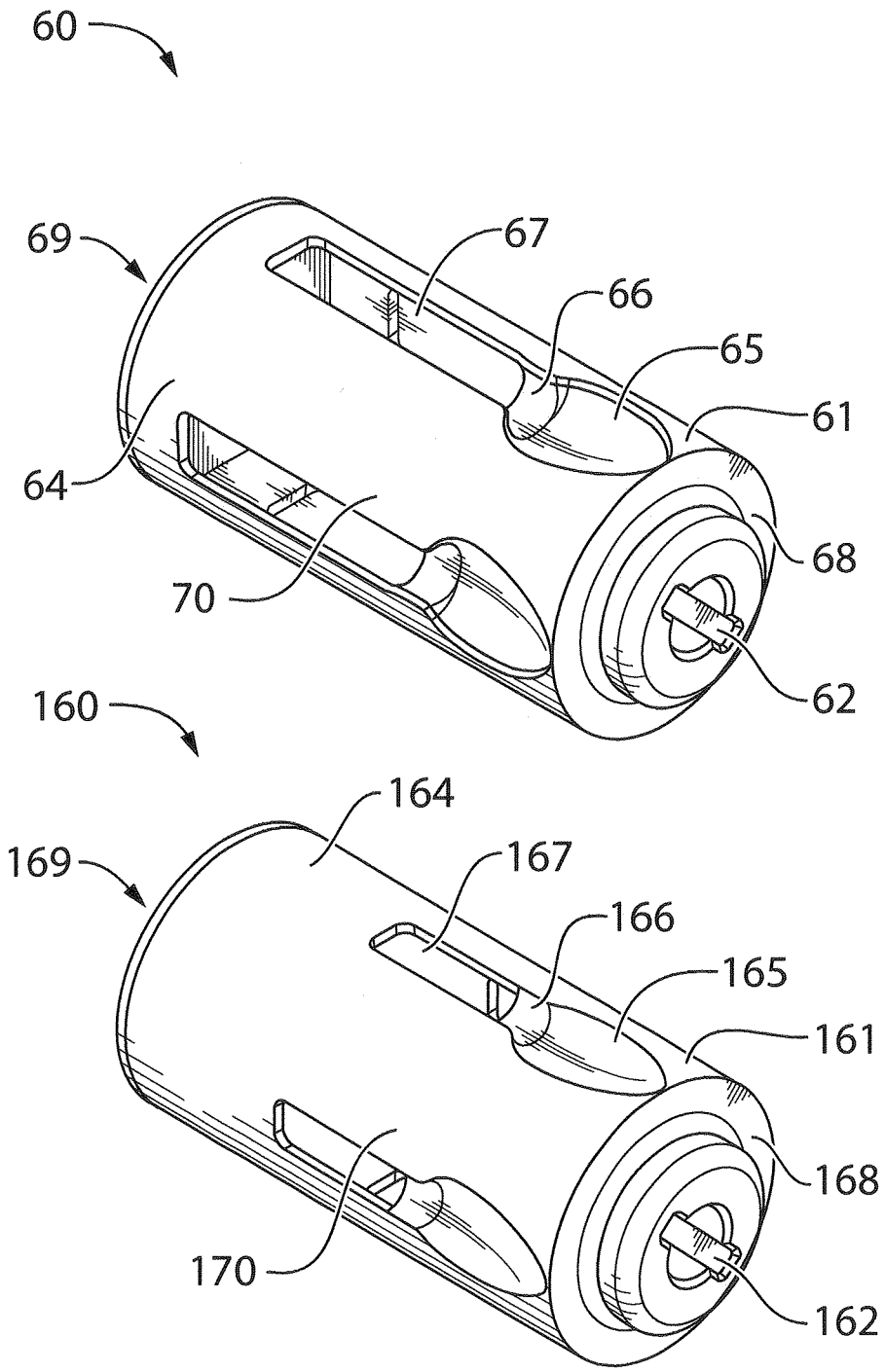
FIG. 9 is a perspective view of the first and second embodiments of the rotor of the dual fluid pressure pulse generator of the first embodiment.
Figure 10:
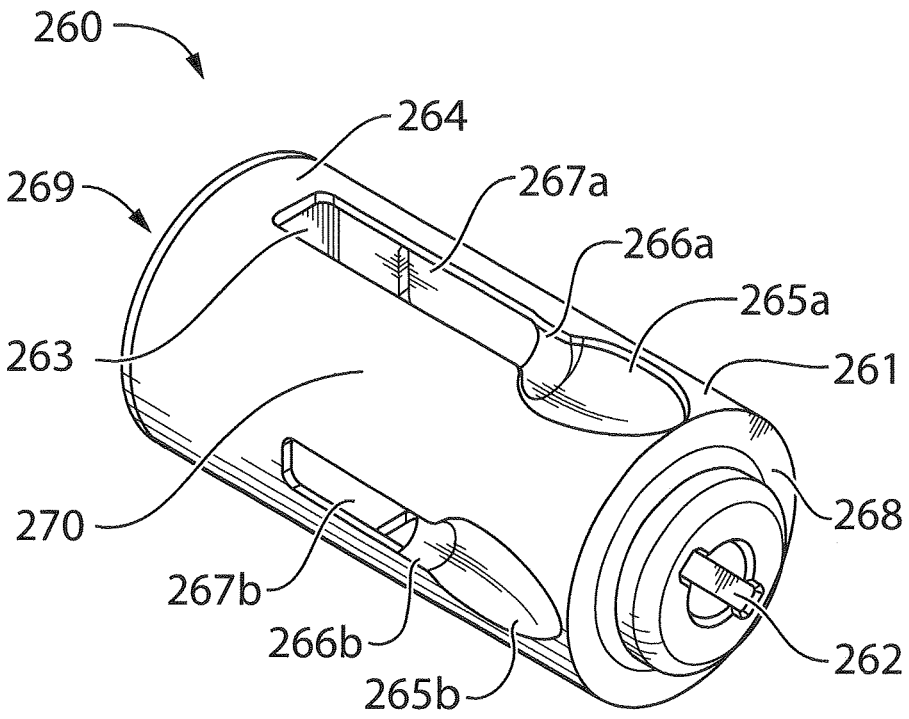
FIG. 10 is a perspective view of a rotor of a dual fluid pressure pulse generator according to a second embodiment.

Referring now to FIGS. 8 and 9, and according to a further embodiment, there is shown a low flow rotor 160 for use in low fluid flow rate conditions, such as in a shallow wellbore or when the drilling fluid is less viscous. As with rotor 60, the low flow rotor 160 comprises a circular body 161 having an uphole end 168 with a drive shaft receptacle 162 and a downhole opening 169. The circular body 161 has four fluid openings 167, four leg sections 170 and a mud lubricated journal bearing ring section 164 similar to the fluid openings 67, leg sections 70 and bearing ring section 64 of rotor 60, however, the fluid openings 167 are shorter and narrower, the leg sections 170 are shorter and wider, and the bearing ring section 164 is wider than the corresponding parts in rotor 60. The circular body 161 also includes four depressions 165 shaped like the head of a spoon and four flow channel 166 on the external surface of the circular body 161 which are similar to the spoon shaped depressions 65 and flow channels 66 of rotor 60, however, the spoon shaped depressions 165 and flow channels 166 are narrower and shallower than the corresponding parts in rotor 60.

The low flow rotor 160 can be easily slotted into stator 40 to replace rotor 60 when low flow rate conditions are predicated. The fluid openings 167 of the low flow rotor 160 have a smaller flow area than the fluid openings 67 of rotor 60 and the total combined flow area of the low flow rotor 160 and stator 40 in each of the three different flow configurations is less than the total combined flow area of the rotor 60 and stator 40. Pressure pulses 5, 6 can therefore be detected at the surface in the reduced or intermediate flow configurations using the low flow rotor 160 in lower fluid flow rate conditions than when using rotor 60.

In alternative embodiments (not shown) the fluid openings 167 of low flow rotor 160 may be of a different shape and configuration provided the flow area of the fluid openings 167 is less than the flow area of fluid openings 67 of rotor 60. The spoon shaped depressions 165 and flow channels 166 of the low flow rotor 160 may be the same or different configuration compared to the spoon shaped depressions 65 and flow channels 66 of rotor 60.

In order to accommodate different fluid flow conditions using rotary valve pulsers that are currently used in downhole drilling, a skilled operator must be brought in to adjust the pulse height gap between the stator and the rotor and specialized tools are required. The low flow rotor 160 and rotor 60 of the present embodiments can be easily interchanged depending on the fluid flow operating conditions, without requiring a skilled operator or specialized tools. The delay on the rig is minimal during set up of the appropriate rotor/stator configuration, thereby saving time and reducing costs. If the low flow rotor 160 is fitted and the flow rate is higher than anticipated such that the reduced flow configuration is not usable because it will generate too much pressure, the low flow rotor 160 can still operate between the full flow configuration and the intermediate flow configuration to generate the intermediate pressure pulse 5 that can be detected at the surface. Similarly, if the flow rate is lower than anticipated and too low to generate a detectable pressure pulse using the intermediate flow configuration, then the low flow rotor 160 can still operate between the full flow configuration and the reduced flow configuration to generate the full pressure pulse 6 that can be detected at the surface.

It is evident from the foregoing that while the embodiments of the low flow rotor 160 shown in FIGS. 8 and 9 utilize four fluid openings 167 a different numbers of rotor fluid openings 167 may be used. For example, in very low flow rate conditions, a rotor with only two truncated fluid openings 167 may be provided to ensure that a pressure pulse is detectable at the surface. Furthermore, the number of rotor fluid openings 167 need not match the number of flow chambers 42, 44 and wall sections 43 in the stator 40. Different combinations may be utilized according to specific operation requirements of the fluid pressure pulse generator. The innovative aspects apply equally in embodiments such as these.

Dual High Flow and Low Flow Dual Pulse Fluid Pressure Pulse Generator

Referring now to FIGS. 10 to 17, there is shown a dual flow stator 240 and dual flow rotor 260 which combine to form a dual flow dual fluid pressure pulse generator 230 according to a second embodiment. The dual flow rotor 260 comprises a circular body 261 having an uphole surface 268 with a drive shaft receptacle 262 and a downhole opening 269. The drive shaft receptacle 262 is configured to receive and fixedly connect with the drive shaft 24 of the pulser assembly 26, such that in use the dual flow rotor 260 is rotated by the drive shaft 24. The dual flow stator 240 comprises a stator body 241 with a circular opening 247 therethrough sized to receive the circular body 261 of the rotor as shown in FIGS. 12 to 17.

The circular body 261 of the rotor has two opposed high flow fluid openings 267*a* and two opposed low flow fluid openings 267*b* separated by four leg sections 270. The high flow fluid openings 267*a* are wider and longer than the low flow fluid openings 267*b*, thereby providing a larger flow area therethrough than the flow area of the low flow fluid openings 267*b*. A mud lubricated journal bearing ring section 264 joins all four leg sections 270 and defines the downhole opening 269. The external surface of the circular body 261 has two opposed high flow depressions 265*a* shaped like the head of a spoon and two opposed low flow depressions 265*b* shaped like the head of a spoon. Each high flow spoon shaped depression 265*a* is connected to one of the high flow fluid openings 267*a* by a high flow channel 266*a* on the external surface of the body 261. Each low flow spoon shaped depression 265*b* is connected to one of the low flow fluid openings 267*b* by a low flow channel 266*b* on the external surface of the body 261. The low flow spoon shaped depressions 265*b* and low flow channels 266*b* are narrower and shallower than the high flow spoon shaped depressions 265*a* and high flow channels 266*a*.

The spoon shaped depressions 265*a*, 265*b* and flow channels 266*a*, 266*b* direct fluid flowing in a downhole direction external to the circular body 261, through the fluid openings 267*a*, 267*b*, into a hollow internal area 263 of the body, and out of the downhole opening 269. In alternative embodiments (not shown) a different curved shaped depression other than the spoon shaped depression may be used on the external surface of the rotor 260, for example but not limited to, egg shaped, oval shaped, arc shaped, or circular shaped. Furthermore, the flow channel 266*a*, 266*b* need not be present and the fluid openings 267*a*, 267*b* may be any shaped opening that allows flow of fluid from the external surface of the rotor 260 through the fluid openings 267*a*, 267*b* to the hollow internal area 263.

The stator body 241 includes two opposed full flow chambers 242, two opposed intermediate flow chambers 244 and two opposed walled sections 243. The bottom face surface 245 of both the full flow chambers 242 and the intermediate flow chambers 244 is angled in the downhole flow direction for smooth flow of fluid through the rotor fluid openings 267*a*, 267*b* during operation. In the embodiment shown in FIGS. 11 to 17, the full flow chambers 242 are L shaped and the intermediate flow chambers 244 are U shaped, however in alternative embodiments (not shown) other configurations may be used for the chambers 242, 244. The geometry of the chambers is not critical provided the flow area of the chambers is conducive to generating the intermediate pulse 5 and no pulse in different flow configurations as described below in more detail. The L shaped configuration of the chambers 242 reduces space requirement for the stator 240 as each L shaped chamber 242 tucks behind one of the walled sections 243 allowing for a compact stator design, which beneficially reduces production costs and results in less likelihood of blockage. In alternative embodiments, the full flow chambers 242 and/or the intermediate flow chambers 244 include bypass channels (not shown) at the downhole end thereof which allow some fluid to flow through the chambers 242, 244 at all times to reduce fluid pressure build up in high fluid flow rate conditions or in deep downhole drilling as discussed above in more detail with reference to FIG. 3*b*.

There are two flow sections positioned on opposed sides of the dual flow stator 240, with each flow section having one of the intermediate flow chambers 244, one of the full flow chambers 242, and one of the wall sections 243; with the full flow chamber 242 positioned between the intermediate flow chamber 244 and the walled section 243. A solid bearing ring section 246 at the downhole end of the stator body 241 helps centralize the rotor in the stator and reduces flow of fluid between the external surface of the rotor 260 and the internal surface of the stator 240.

In use, the dual flow dual fluid pressure pulse generator 230 can operate in either a high flow or a low flow mode depending on the fluid flow conditions downhole. For example, the high flow mode may be used for deep downhole drilling with high fluid flow rates or when the drilling mud is heavy or viscous, and the low flow mode may be used for shallower downhole drilling with low fluid flow rates or when the drilling mud is less viscous. In the high flow mode, the high flow fluid openings 267*a* of the rotor 260 line up with the two opposed flow sections of the stator 240, to allow flow of fluids through the high flow fluid openings 267*a*. In the low flow mode the low flow fluid openings 267*b* of the rotor 260 line up with the two opposed flow sections of the stator 240, to allow flow of fluids through the low flow fluid openings 267*b*. As the flow area of the high flow fluid openings 267*a* is larger than the flow area of the low flow fluid openings 267*b*, the high flow mode can be used with higher fluid flow rates or more viscous drilling fluid without excessive pressure buildup than the low flow mode, whereas the low mode can be used with low fluid flow rates or less viscous drilling mud and still pick up a detectable pressure signal at the surface.

The stator 240 includes a deactivation zone comprising two opposed curved walls 248 with the top of the curved walls 248 substantially in line with the uphole surface 268 of the rotor when the rotor and stator are fitted together as shown in FIGS. 12 to 17. In the high flow mode, the curved walls 248 cover the low flow spoon shaped depressions 265*b*, low flow channels 266*b* and low flow openings 267*b* to block flow of fluids through the low flow fluid openings 267*b*. In the low flow mode, the curved walls 248 cover the high flow spoon shaped depressions 265*a*, high flow channels 266*a* and high flow openings 267*a* to block flow of fluids through the high flow fluid openings 267*a*.

Figure 12:
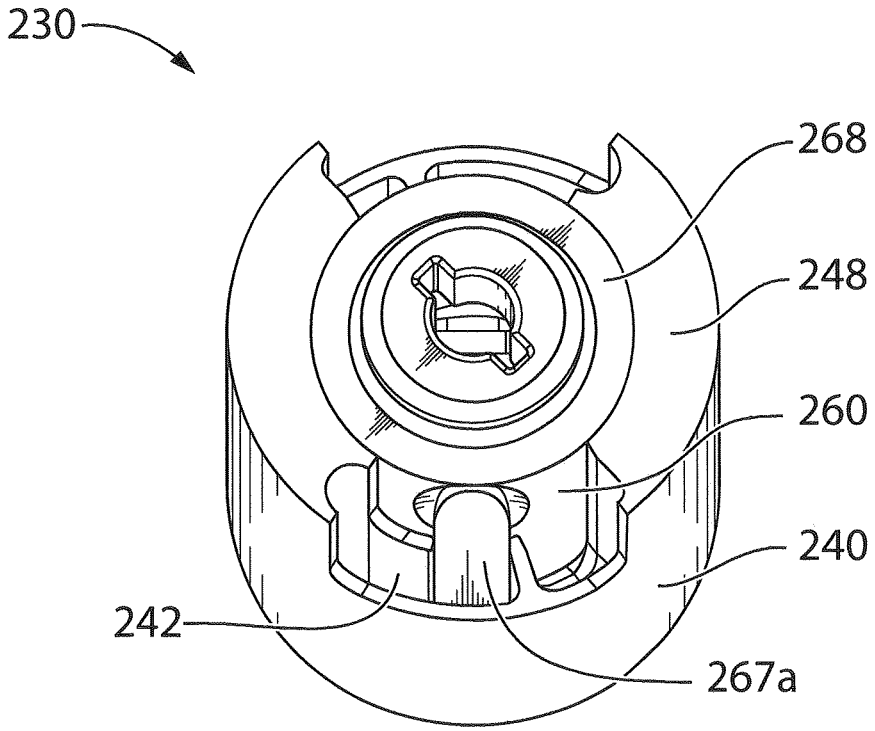
FIG. 12 is a perspective view of the rotor/stator combination of the dual fluid pressure pulse generator of the second embodiment in high flow mode full flow configuration.
Figure 13:
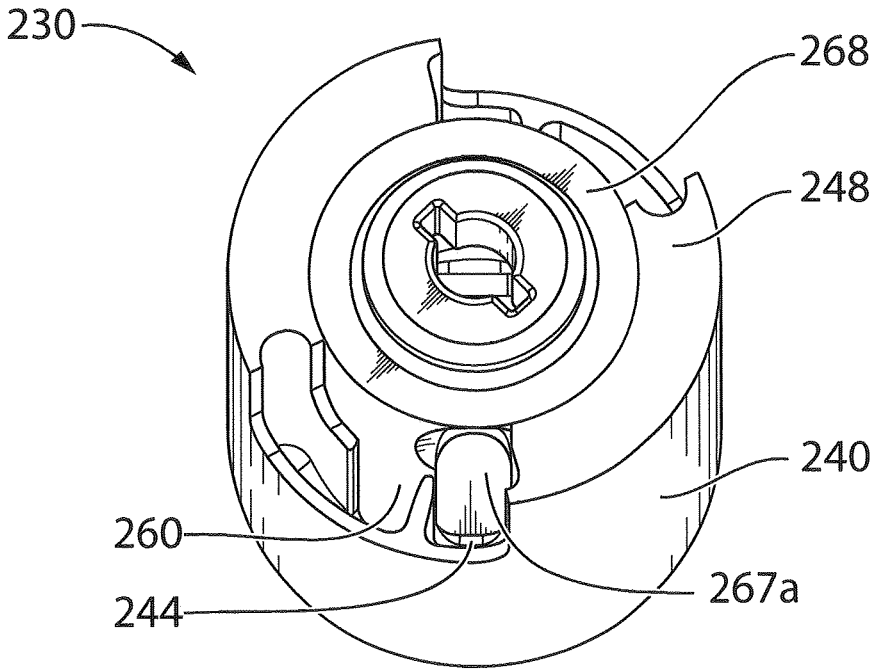
FIG. 13 is a perspective view of the rotor/stator combination of the dual fluid pressure pulse generator of the second embodiment in high flow mode intermediate flow configuration.
Figure 14:
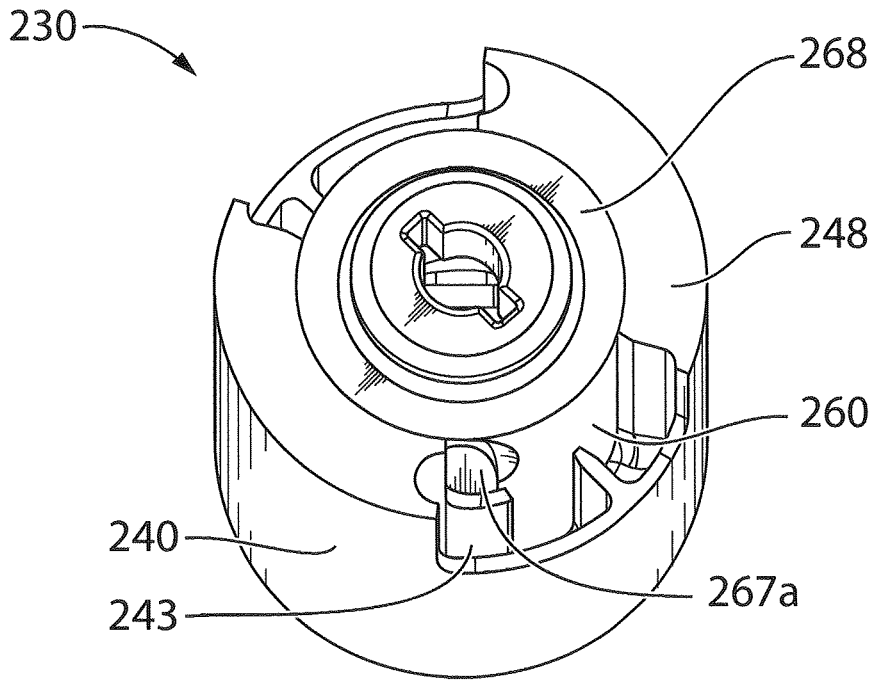
FIG. 14 is a perspective view of the rotor/stator combination of the dual fluid pressure pulse generator of the second embodiment in high flow mode reduced flow configuration.
Figure 15:
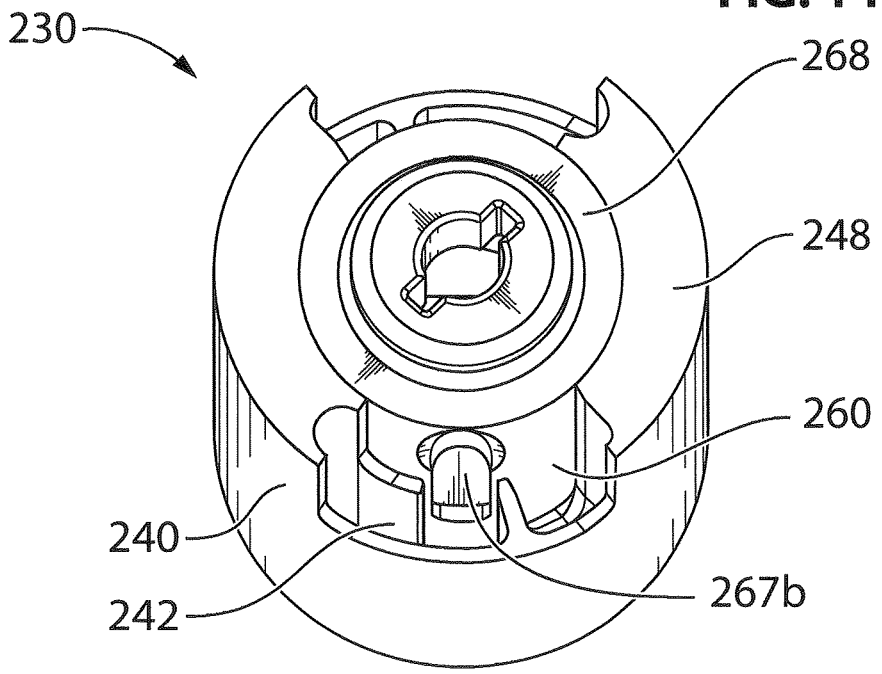
FIG. 15 is a perspective view of the rotor/stator combination of the dual fluid pressure pulse generator of the second embodiment in low flow mode full flow configuration.
Figure 16:
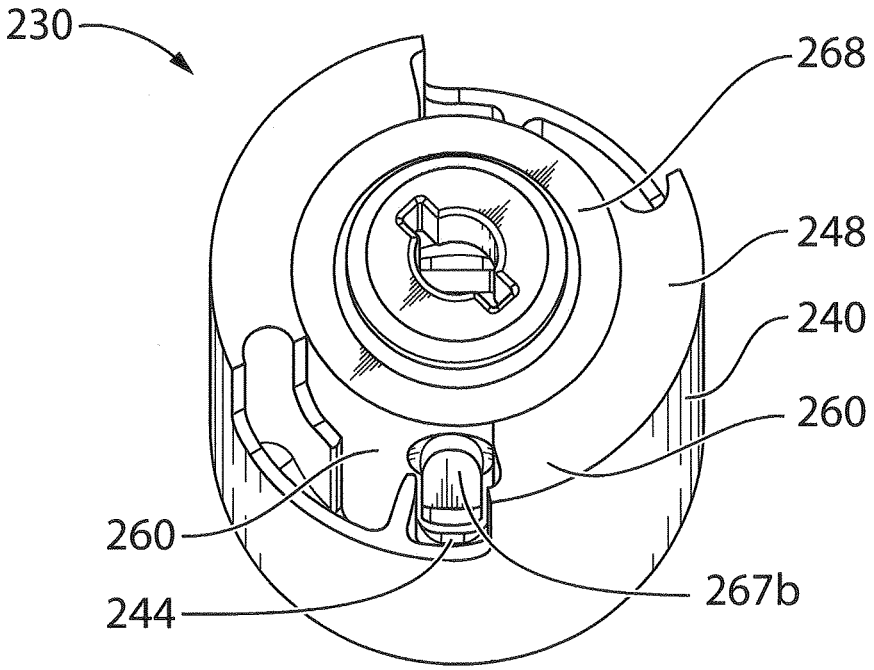
FIG. 16 is a perspective view of the rotor/stator combination of the dual fluid pressure pulse generator of the second embodiment in low flow mode intermediate flow configuration.
Figure 17:
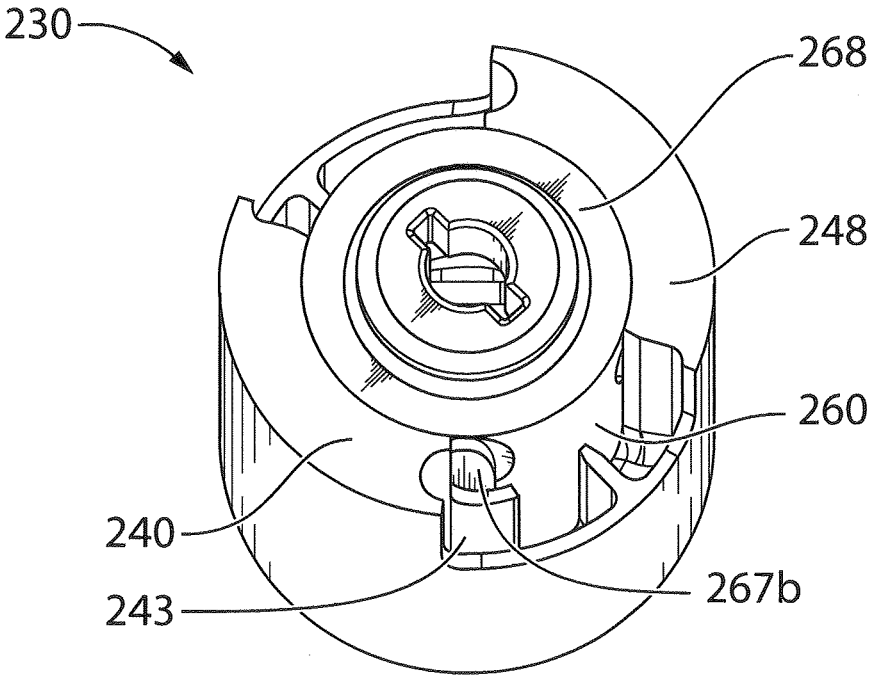
FIG. 17 is a perspective view of the rotor/stator combination of the dual fluid pressure pulse generator of the second embodiment in low flow mode reduced flow configuration.

In use, the dual flow rotor 260 rotates between six different flow configurations as follows:

1. High flow mode full flow—where the rotor high flow fluid openings 267*a* align with the stator full flow chambers 242, as shown in FIG. 12;
2. High flow mode intermediate flow—where the rotor high flow fluid openings 267*a* align with the stator intermediate flow chambers 244, as shown in FIG. 13;
3. High flow mode reduced flow—where the rotor high flow fluid openings 267*a* align with the stator walled sections 243, as shown in FIG. 14;
4. Low flow mode full flow—where the rotor low flow fluid openings 267*b* align with the stator full flow chambers 242, as shown in FIG. 15;
5. Low flow mode intermediate flow—where the rotor low flow fluid openings 267*b* align with the stator intermediate flow chambers 244, as shown in FIG. 16; and
6. Low flow mode reduced flow—where the rotor low flow fluid openings 267*b* align with the stator walled sections 243, as shown in FIG. 17.

In operation, the dual flow dual fluid pressure pulse generator 230 can generate the full pressure pulse 6 and intermediate pressure pulse 5 for both the high flow mode and low flow mode and the operator can easily rotate between any of the six different flow configurations described above depending on fluid flow conditions downhole. There is no need for the operator to halt operations and change the fluid pressure pulse generator when different fluid flow conditions are detected, thereby beneficially reducing time delays and reducing costs.

In alternative embodiments, the full flow chambers 242 and/or the intermediate flow chambers 244 of the dual flow stator 240 include a bypass channel (not shown) at the downhole end thereof which allows some drilling fluid to flow out of the chambers 242, 244 in all six flow configurations. As the flow of fluid through the bypass channels is relatively constant in all flow configurations, it does not affect generation of the dual pressure pulses 5, 6 in the low flow and high flow mode.

It is evident from the foregoing that while the embodiments shown in FIGS. 10 to 17 utilize two high flow fluid openings 267*a* and two low flow fluid openings 267*b* in the dual flow rotor 240 a different number of fluid openings may be present. Furthermore, a different number of stator flow sections may be present instead of the two opposed flow sections shown in FIGS. 10 to 17. Different combinations may be utilized according to specific operation requirements of the dual flow dual fluid pressure pulse generator 230. In alternative embodiments (not shown) the stator intermediate flow chambers 244 need not be present or there may be additional intermediate flow chambers present that have a flow area less than the flow area of the full flow chambers 242. The flow area of the additional intermediate flow chambers may vary to produce additional intermediate pressure pulses and increase the data rate of the dual flow dual fluid pressure pulse generator 230. The innovative aspects apply equally in embodiments such as these.

While the embodiments shown in FIGS. 10 to 17 utilize fluid openings in the dual flow rotor 260 and flow chambers in the dual flow stator 240, in alternative embodiments (not shown) the high flow and low flow fluid openings may be positioned in the dual flow stator and the flow sections and deactivation zone may be present in the dual flow rotor. In these alternative embodiments the rotor still operates in the high flow mode and low flow mode and rotates between the six different flow configurations whereby the high flow fluid openings or the low flow fluid openings in the stator align with full flow chambers, intermediate flow chambers and wall sections of the rotor. The innovative aspects apply equally in embodiments such as these.

Single Fluid Pressure Pulse Generator

Referring now to FIGS. 18 to 24, there is shown a first and second embodiment of a single fluid pressure pulse generator 330 comprising a single pulse stator 340*a,b* and a rotor 60, 160, 360. The single fluid pressure pulse generator 330 can be used to generate a single sized pressure pulse 6 in various flow conditions as discussed above with reference to FIG. 1*b*. For example, in low flow rate conditions the intermediate pressure pulses 5 of the dual fluid pressure pulse generators 30, 230 described above may not be readily distinguishable from the full pressure pulses 6 causing data interpretation errors. The single fluid pressure pulse generator 330 may beneficially reduce the data interpretation errors in low flow conditions as only full pressure pulses 6 are generated. The single fluid pressure pulse generator 330 may also be used in extra deep wellbores in any flow conditions to create a pulse of significant height that is detectable on the surface. In such conditions the intermediate pulse 5 of the dual pulse fluid pressure pulse generators 30, 230 described above would typically not be strong enough to be detected at the surface and a single fluid pressure pulse generator 330 is required to produce a strong full pulse 6 that can be detected at the surface.

In the first embodiment shown in FIGS. 18 to 21 rotor 360 combines with single pulse stator 340*a* to provide single fluid pressure pulse generator 330. Rotor 360 comprises a circular body 361 having an uphole surface 368 with a drive shaft receptacle 362 and a downhole opening 369. The drive shaft receptacle 362 is configured to receive and fixedly connect with the drive shaft 24 of the pulser assembly 26, such that in use the rotor 360 is rotated by the drive shaft 24. The rotor circular body 361 has four fluid openings 367 separated by four leg sections 370. A mud lubricated journal bearing ring section 364 joins all four leg sections 370 and defines the downhole opening 369. The external surface of the circular body 361 has four flow depressions 365 shaped like the head of a spoon connected to the fluid openings 367 by a channel 366. Fluid openings 367, spoon shaped depressions 365 and channels 366 are wider (up to about 50% wider) than the fluid openings 67, spoon shaped depressions 65 and channels 66 of the rotor 60 shown in FIG. 4. The fluid openings 367 of rotor 360 are also longer than the fluid openings 67 of rotor 60. The fluid openings 367, spoon shaped depressions 365 and channels 366 are wider to match the wider flow chambers 342*a* of the single pulse stator 340*a* shown in FIG. 18. The stator flow chambers 342*a* of single pulse stator 340*a* can be wider as there are only 4 flow chambers instead of the 8 flow chambers of the dual pulse stator 40 shown in FIGS. 3*a* and 3*b*. The spoon shaped depressions 365 and channels 366 may also be deeper than the spoon shaped depressions 65 and channels 66 of the rotor 60 of the dual fluid pressure pulse generator 30. In alternative embodiments, different geometries of the fluid openings 367, spoon shaped depressions 365 and channels 366 of the rotor 360 may be utilized.

The spoon shaped depressions 365 and flow channels 366 direct fluid flowing in a downhole direction external to the circular body 361, through the fluid openings 367 into a hollow internal area 363 of the body, and out of the downhole opening 369. The spoon shaped depressions 365 act as a nozzle to aid fluid flow. Without being bound by science, it is thought that the nozzle design results in increased volume of fluid flowing through the fluid opening 367 compared to an equivalent fluid diverter without the nozzle design, such as the window fluid opening of the rotor/stator combination described in U.S. Pat. No. 8,251,160. Curved edges 371 of the spoon shaped depressions 365 also provide less resistance to fluid flow and reduction of pressure losses across the rotor/stator as a result of optimal fluid geometry. Furthermore, the curved edges 371 of the spoon shaped depressions 365 have a reduced surface compared to, for example, a channel having the same flow area as the spoon shaped depression 365. This means that the surface area of the curved edges 371 cutting through fluid when the rotor is rotated is reduced, thereby reducing the force required to turn the rotor and reducing the motor torque requirement. By reducing the motor torque requirement, there is beneficially a reduction in battery consumption and less wear on the motor, beneficially reducing costs.

Motor torque requirement is also reduced by reducing the surface area of edges 372 of each leg section 370 which are perpendicular to the direction of rotation. Edges 372 cut through the fluid during rotation of the rotor 360 and therefore beneficially have as small a surface area as possible whilst still maintaining structural stability of the leg sections 370. To increase structural stability of the leg sections 370, the thickness at the middle of the leg section 370 furthest from the edges 372 may be greater than the thickness at the edges 372, although the wall thickness of each leg section 370 may be the same throughout. In addition, the bearing ring section 364 of the circular body 361 provides structural stability to the leg sections 370.

In alternative embodiments (not shown) a different curved shaped depression other than the spoon shaped depression may be used on the external surface of the rotor 360, for example but not limited to, egg shaped, oval shaped, arc shaped, or circular shaped. Furthermore, the flow channel 366 need not be present and the fluid openings 367 may be any shaped opening that allows flow of fluid from the external surface of the rotor through the fluid openings 367 to the hollow internal area 363.

Figure 18:
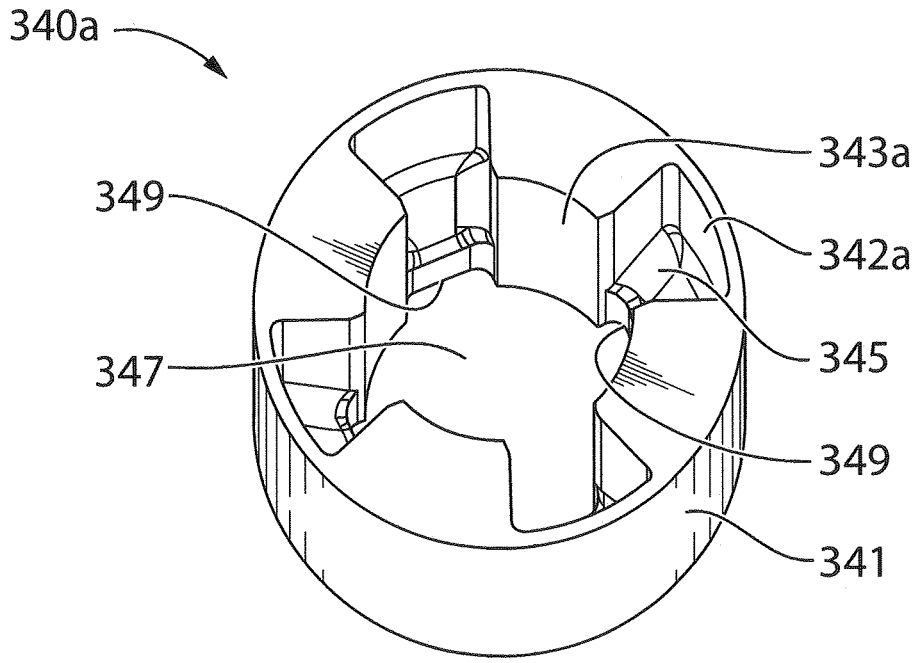
FIG. 18 is a perspective view of a first embodiment of a stator of a single fluid pressure pulse generator according to a first embodiment.
Figure 20:
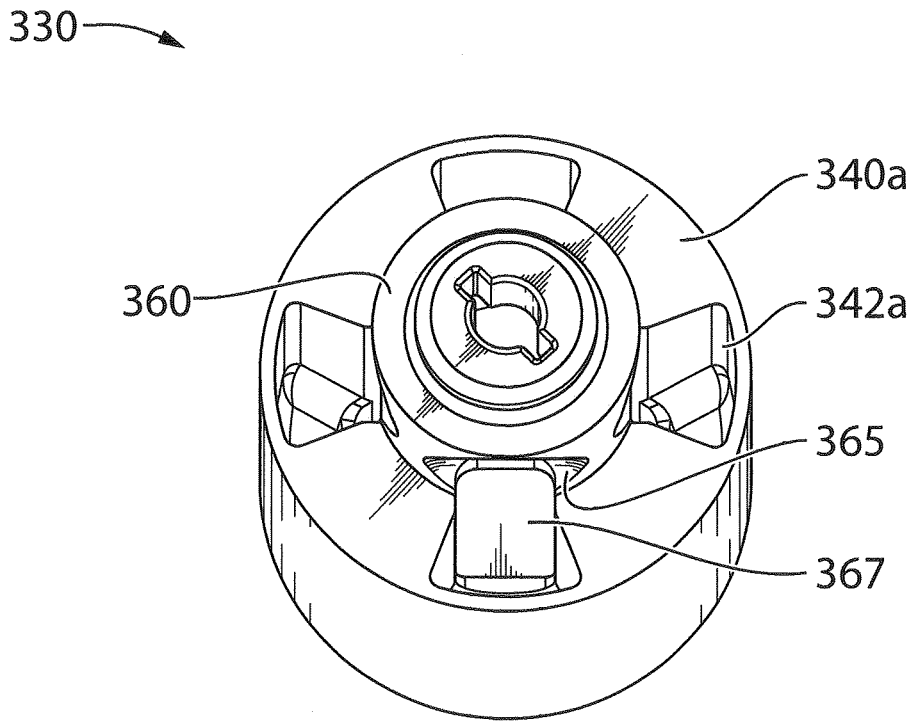
FIG. 20 is a perspective view of the rotor/stator combination of the single fluid pressure pulse generator of the first embodiment in full flow configuration.
Figure 21:
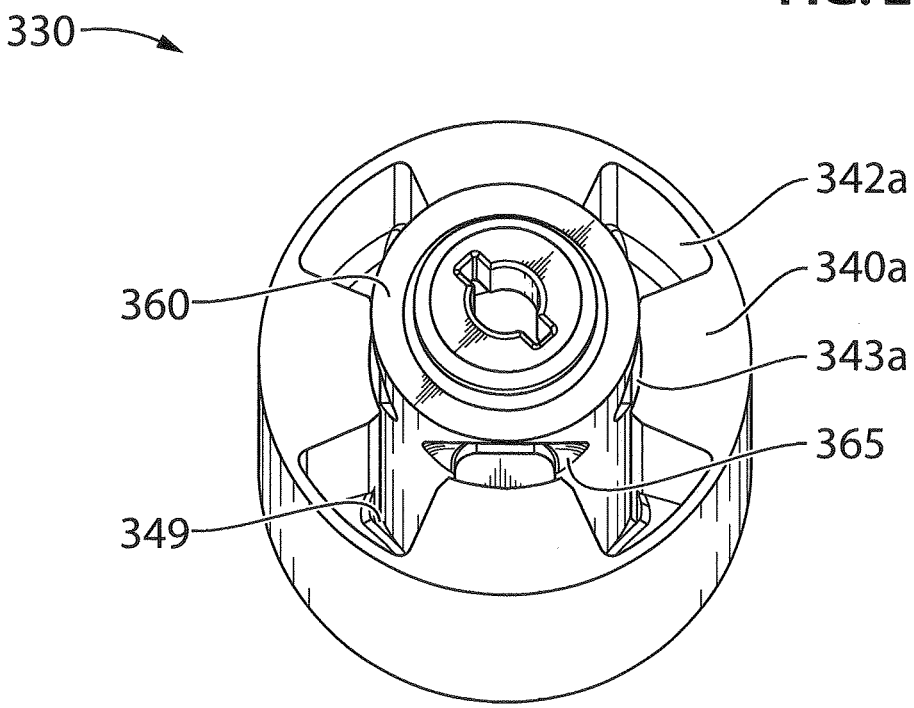
FIG. 21 is a perspective view of the rotor/stator combination of the single fluid pressure pulse generator of the first embodiment in reduced flow configuration.
Figure 22:
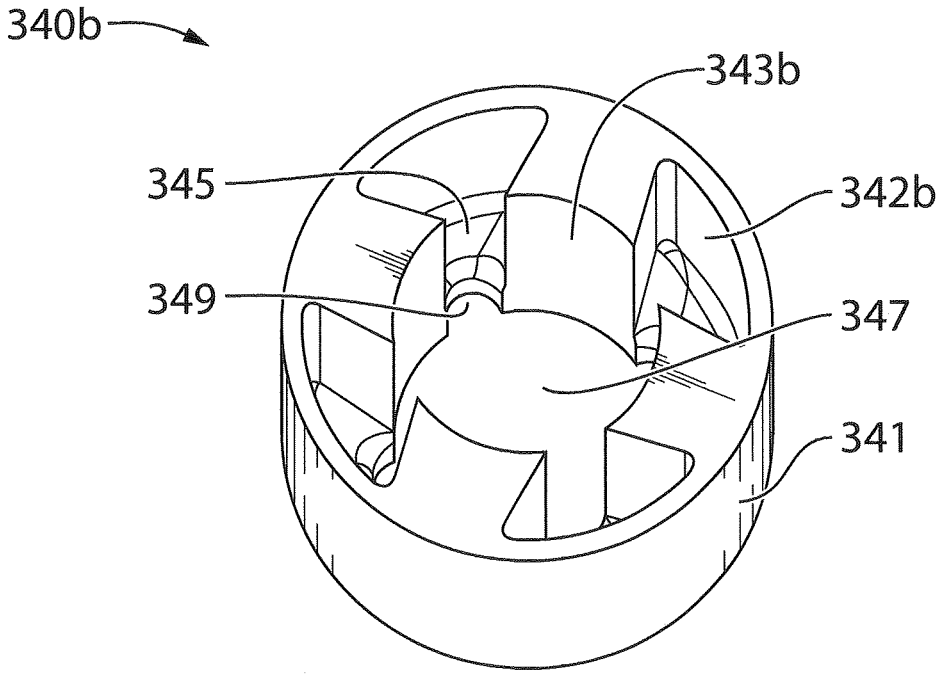
FIG. 22 is a perspective view of a stator of a single fluid pressure pulse generator according to a second embodiment.
Figure 23:
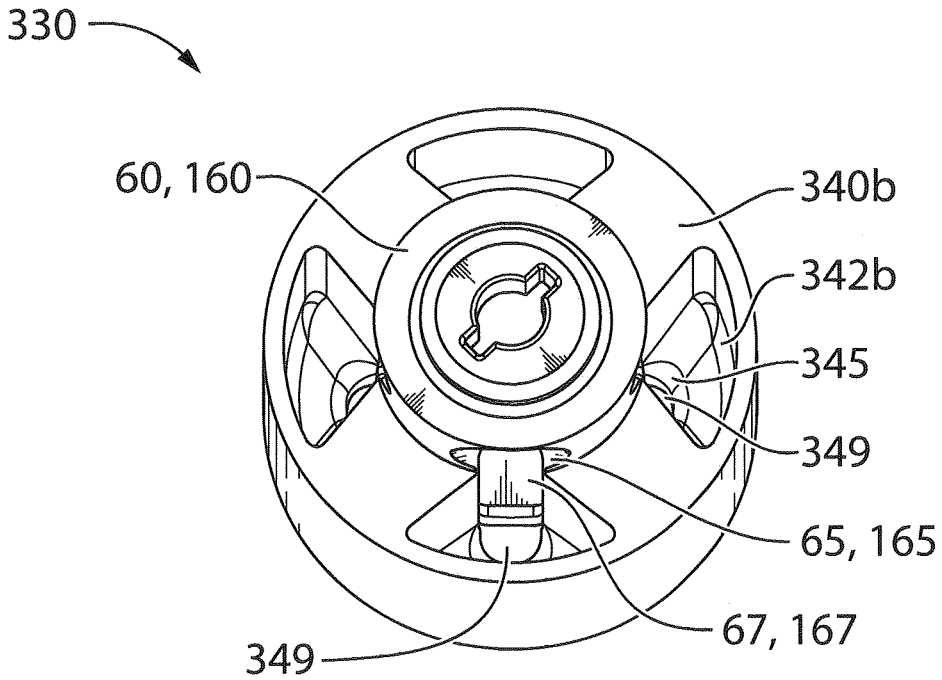
FIG. 23 is a perspective view of the rotor/stator combination of the single fluid pressure pulse generator of the second embodiment in full flow configuration.

In both the first and second embodiment of the single pulse stator 340*a* and 340*b* shown in FIGS. 18 and 22 respectively, the stator body 341 includes four equally spaced full flow chambers 342*a,b* and four walled sections 343*a,b* positioned between the full flow chambers 342*a,b*. The full flow chambers 342*a,b* are U shaped and have a bottom face surface 345 angled in the downhole flow direction for smooth flow of fluid. A portion of each side of the U-shaped chambers 342*a,b* extends behind the walled sections 343*a,b* to increase the chamber area. The U-shaped full flow chambers 342*a,b* and bottom face surfaces 345 provide smooth flow of fluid from the chambers through the rotor fluid openings when the single fluid pressure pulse generator 330 is in the full flow configuration as shown in FIGS. 20 and 23 and described in more detail below. The chambers 342*a,b* each have a fluid flow bypass channel 349 at the downhole end thereof which allows some drilling fluid to flow out of the chambers 342*a,b* when the fluid pressure pulse generator 330 is in the reduced flow configuration shown in FIGS. 21 and 24 and described below in more detail. This reduces or prevents cavitation in the chambers 342*a,b* which can be an issue for deep well drilling. In alternative embodiments, other configurations may be used for the chambers 342*a,b* provided the flow area of the chambers is conducive to generating no or minimal pulse in the full flow configuration.

The full flow chambers 342*b* of the single pulse stator 340*b* of the second embodiment shown in FIG. 22 are dimensioned to correspond in size to the fluid openings 67, 167 of the rotor 60 or low flow rotor 160 shown in FIG. 9. The single pulse stator 340*b* can therefore be used with rotor 60 or low flow rotor 160 to generate full pressure pulses 6. The low flow rotor 160 and rotor 60 of the present embodiments can be easily interchanged depending on the fluid flow operating conditions. This provides flexibility as either rotor 60 or low flow rotor 160 can be attached to the drive shaft 24 of the pulser assembly 26 and either dual pulse stator 40 or single pulse stator 340*b* chosen depending on flow rate conditions downhole. For example in very low flow rate conditions, the low flow rotor 160 and single pulse stator 340*b* may be chosen in order to produce a full pressure pulse 6 which is of sufficient height to be detected at surface.

Figure 19:
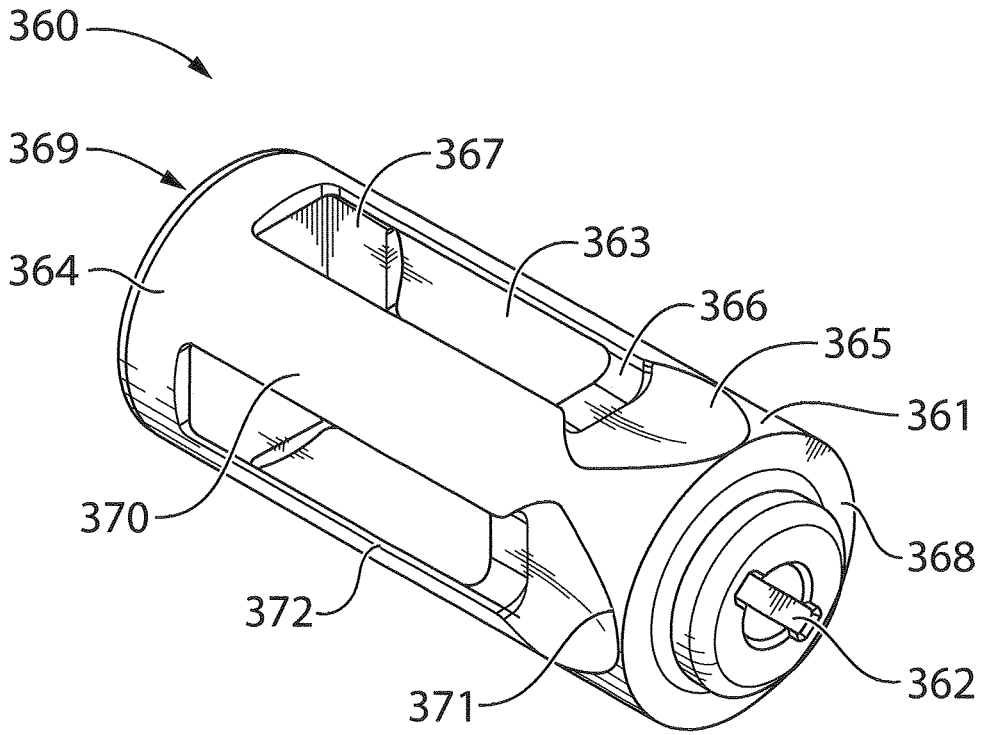
FIG. 19 is a perspective view of a rotor of the single fluid pressure pulse generator of the first embodiment.

The single pulse stator 340*a* of the first embodiment shown in FIG. 18 has full flow chambers 342*a* dimensioned to correspond to the wider fluid openings 367 of the rotor 360 shown in FIG. 19. In alternative embodiments, a low flow rotor (not shown) may also be provided which has fluid openings with a reduced flow area (for example shorter in length) compared to the fluid openings 367 of rotor 360 shown in FIG. 19. Either the rotor 360 or the low flow rotor (not shown) may be attached to the drive shaft 24 of the pulser assembly 26 and used with the single pulse stator 340*a* to generate full pressure pulses 6 depending on flow conditions downhole.

In use, the rotor 60, 160, 360 is rotated in the fixed stator 340*a,b* to provide two different flow configurations as follows:

1. Full flow—where the rotor fluid openings 367 align with the stator full flow chambers 342*a* as shown in FIG. 20, or the rotor fluid openings 67, 167 align with the stator full flow chambers 342*b* as shown in FIG. 23;
2. Reduced flow—where the rotor fluid openings 367 align with the stator walled sections 343*a* as shown in FIG. 21, or the rotor fluid openings 67, 167 align with the stator walled sections 343*b* as shown in FIG. 24.

In the full flow configuration shown in FIGS. 20 and 23, the stator full flow chambers 342*a,b* align with the fluid openings 67, 167, 367 of the rotor, so that fluid flows from the full flow chambers 342*a,b* through the fluid openings 67, 167, 367. Some fluid will also flow through the bypass channels 349 in the full flow chambers 342*a,b*. The flow area of full flow chambers 342*a* may correspond to the flow area of the rotor fluid openings 367. The flow area of full flow chambers 342*b* may correspond to the flow area of fluid openings 67 of rotor 60 and be greater than the flow area of fluid openings 167 of low flow rotor 160.

Figure 24:
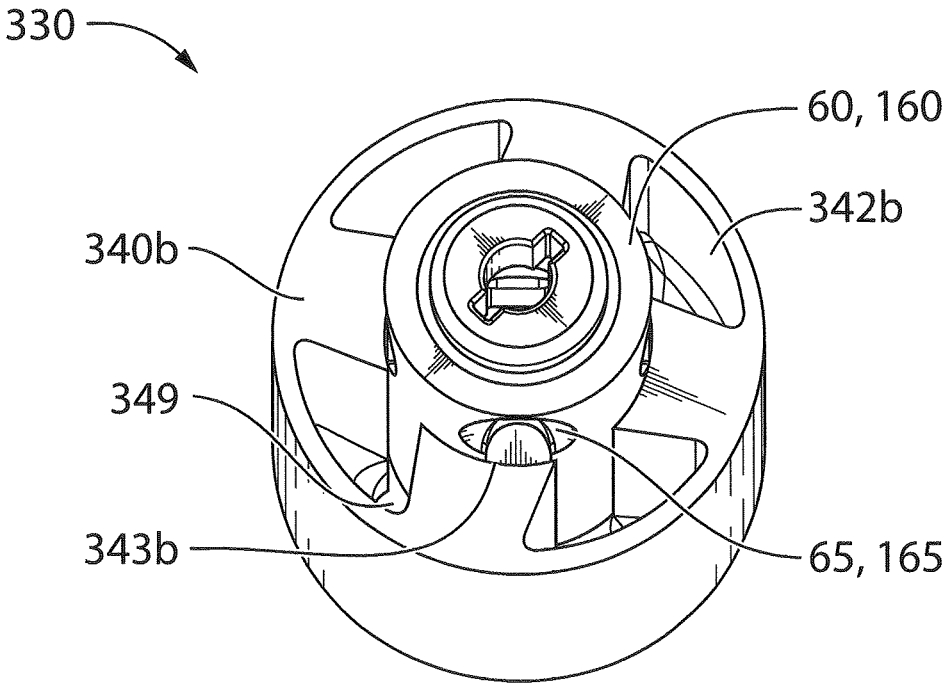
FIG. 24 is a perspective view of the rotor/stator combination of the single fluid pressure pulse generator of the second embodiment in reduced flow configuration.

When the rotor 60, 160, 360 is positioned in the reduced flow configuration as shown in FIGS. 21 and 24, the stator walled sections 343*a,b* align with the fluid openings 67, 167, 367 of the rotor. Fluid is still diverted by the spoon shaped depressions 65, 165, 365 through the fluid openings 67, 167, 367 and fluid also flows through the bypass channels 349; however, the total overall flow of fluids in the reduced flow configuration is reduced compared to the total overall flow of fluids in the full flow configuration. The fluid pressure therefore increases to generate pressure pulse 6.

In some embodiments, the rotor 360 and/or stator 340*a,b* of the single fluid pressure pulse generator 330 may be configured to decrease the amount of fluid flowing through the pulse generator in the reduced flow configuration compared to a standard dual or single fluid pressure pulse generator. This can be done by reducing the flow area of the rotor fluid openings and/or by reducing the flow area of bypass channels 349 of the full flow chambers 342*a,b*. A higher (larger) full pressure pulse 6 is thereby generated in the reduced flow configuration. Generation of higher pressure pulses 6 is useful in deep well drilling as the pulse is stronger and more likely to be detected at the surface. Decreasing the amount of fluid flowing through the pulse generator in the reduced flow configuration may also be useful in low fluid flow rate conditions in order to generate a the full pressure pulse 6 of similar pulse height as a full pressure pulse 6 generated by a standard dual or single fluid pressure pulse generator in regular fluid flow rate conditions.

It is evident from the foregoing that while the embodiments of the single fluid pressure pulse generator 330 shown in FIGS. 18 to 24 utilize four rotor fluid openings 60, 160, 367 together with four full flow chambers 342*a,b* and four wall sections 343*a,b* in the stator, different numbers of rotor fluid openings 60, 160, 367, full flow chambers 342*a,b* and wall sections 343*a,b* may be used. Provision of more fluid openings 67, 167, 367, full flow chambers 342*a,b* and wall sections 343*a,b* beneficially reduces the amount of rotor rotation required to move between the different flow configurations, however, too many fluid openings 67, 167, 367, full flow chambers 342*a,b* and wall sections 343*a,b* decreases the stability of the rotor and/or stator and may result in a less compact design thereby increasing production costs. Furthermore, the number of rotor fluid openings 67, 167, 367 need not match the number of full flow chambers 342*a,b* and wall sections 343*a,b*. Different combinations may be utilized according to specific operation requirements of the single fluid pressure pulse generator 330. The innovative aspects apply equally in embodiments such as these.

It is also evident from the foregoing that while the embodiments shown in FIGS. 18 to 24 utilize fluid openings in the rotor 60, 160, 360 and flow chambers in the stator 340*a,b*, in alternative embodiments (not shown) the fluid openings may be positioned in the stator and the flow chambers may be present in the rotor. In these alternative embodiments the rotor still rotates between full flow and reduced flow configurations whereby the fluid openings in the stator align with flow chambers and wall sections of the rotor respectively. The innovative aspects apply equally in embodiments such as these.

Figure 11:
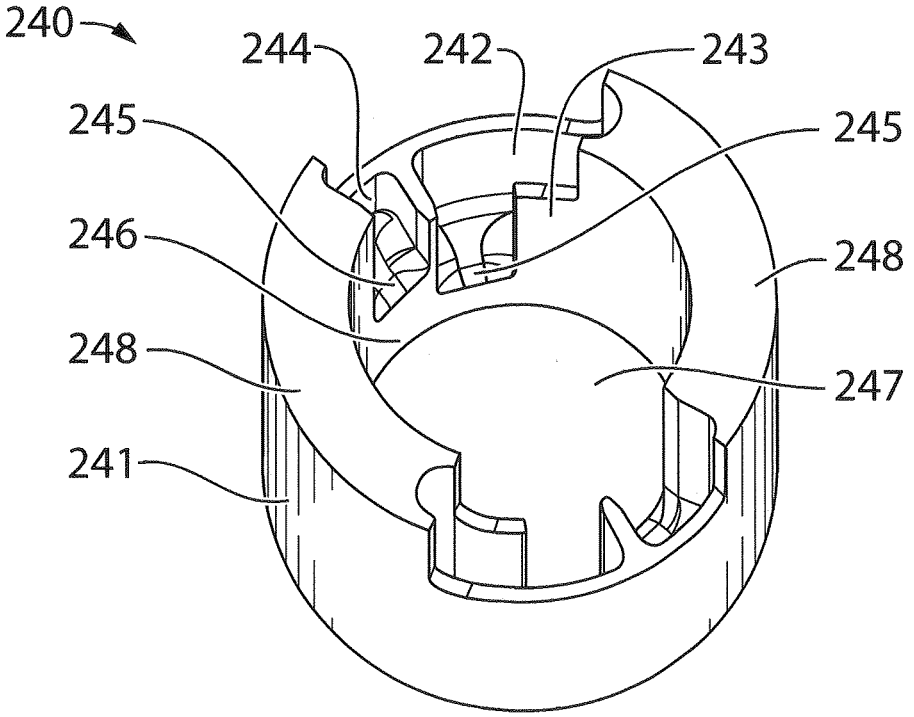
FIG. 11 is a perspective view of a stator of the dual fluid pressure pulse generator of the second embodiment.

In alternative embodiments (not shown) a dual flow single fluid pressure pulse generator may be provided which is similar to the dual flow dual fluid pressure pulse generator described above with reference to FIGS. 10 to 17, however there are no intermediate flow chambers and only full flow chambers are present in a dual flow single pulse stator (not shown). The dual flow rotor 260 shown in FIG. 10 which includes high flow fluid openings 267*a* and low flow fluid openings 267*b* may be used with the dual flow single pulse stator. The dual flow rotor 260 can be positioned in a high flow mode configuration or a low flow mode configuration. In the high flow mode configuration, the dual flow rotor 260 rotates between:

- a high flow mode full flow configuration whereby the rotor high flow fluid openings 267*a* and full flow chambers of the dual flow single pulse stator (not shown) align and no pressure pulse is generated; and
- a high flow mode reduced flow configuration whereby the rotor high flow fluid openings 267*a* and wall sections of the dual flow single pulse stator (not shown) align generating fluid pressure pulse 6;

In the low flow mode configuration, the dual flow rotor rotates between:

- a low flow mode full flow configuration whereby the rotor low flow fluid openings 267*b* and full flow chambers of the dual flow single pulse stator (not shown) align and no pressure pulse is generated; and
- a low flow mode reduced flow configuration whereby the rotor low flow fluid openings 267*b* and wall sections of the dual flow single pulse stator (not shown) align generating fluid pressure pulse 6;

The dual flow single pulse stator may include a deactivation zone similar to the deactivation zone 248 of the dual flow dual pulse stator 240 shown in FIG. 11. As the same dual flow rotor 260 shown in FIG. 10 can be used with a dual flow single pulse stator (not shown) or with the dual flow dual pulse stator 240 shown in FIG. 11, the dual flow rotor 260 can be attached to the drive shaft 24 of the pulser assembly 26 and either the dual flow dual pulse stator 240 or the dual flow single pulse stator can be chosen depending on flow rate conditions downhole. For example, in deep well drilling or very low flow conditions the dual flow single pulse stator may be chosen.

One Size Fits all MWD Tool

In the embodiments disclosed herein, it is possible to utilize various different sized stators 40, 240, 340*a,b* to fit a variety of different downhole drilling operations. The stator size may vary depending on the drill collar dimensions and is typically sized to be snugly received within the drill collar. This allows the rotor, 60, 160, 260, 360 to be connected to the drive shaft 24 of the MWD tool 20, with only the stator 40, 240, 340*a,b* being sized depending on the dimensions of the drill string. It is therefore possible to service a range of different downhole drilling operations with a one size fits all MWD tool 20 including the rotor 60, 160, 260, 360 in combination with a variety of different sized stators 40, 240, 340*a,b*.

As discussed above, the same rotor 60, 160 can be used with a dual pulse stator 40 or a single pulse stator 340*a,b*. Furthermore, the same dual flow rotor 260 can be used with a dual flow dual pulse stator 240 or a dual flow single pulse stator (not shown). The rotor 60, 160 can therefore be connected to the drive shaft 24 of the MWD tool 20 and the operator can chose the dual pulse stator 40 or the single pulse stator 340*a,b* depending on the drilling conditions downhole. Alternatively, the dual flow rotor 260 can be connected to the drive shaft 24 of the MWD tool 20 and the operator can chose the dual flow dual pulse stator 240 or the dual flow single pulse stator (not shown) depending on the drilling conditions downhole.

Staged Oscillation Method

A staged oscillation method can be used for generating dual pressure pulses 5, 6 as shown in FIG. 1*a*. The method involves oscillating the rotor 60, 160, 260 of the dual fluid pressure pulse generator 30, 230 back and forth between the full flow, intermediate flow and reduced flow configurations to generate a pattern of pressure pulses. The rotor 60, 160, 260 starts in the full flow configuration with the rotor fluid openings 67, 167, 267*a*, 267*b* aligned with the stator full flow chambers 42, 242 so there is minimal pressure. The rotor 60, 160, 260 then rotates to either one of two different positions depending on the pressure pulse pattern required as follows:

- Position 1—rotation 30 degrees in an anticlockwise direction to the intermediate flow configuration where the rotor fluid openings 67, 167, 267*a*, 267*b* align with the stator intermediate flow chambers 44, 244 to generate the intermediate pressure pulse 5; or
- Position 2—rotation 30 degrees in a clockwise direction to the reduced flow configuration where the rotor fluid openings 67, 167, 267*a*, 267*b* align with the stator walled sections 43, 243 to generate the full pressure pulse 6.

After generation of each of the pressure pulses 5, 6, the rotor returns to the start position (i.e. full flow configuration with minimal pressure) before generating the next pressure pulse. For example, the rotor can rotate in the following pattern:

- start position-position 1-start position-position 1-start position-position 2-start position This will generate:

- intermediate pressure pulse 5-intermediate pressure pulse 5-full pressure pulse 6.

Return of the rotor 60, 160, 260 to the start position between generation of each pressure pulse allows for a constant re-check of timing and position for signal processing and precise control. The start position at zero or minimal pressure provides a clear indication of the end of a previous pulse and start of a new pulse. Also if the rotor 60, 160, 260 is knocked during operation or otherwise moves out of position, the rotor 60, 160, 260 returns to the start position to recalibrate and start over. This beneficially reduces the potential for error over the long term performance of the dual pulse fluid pressure pulse generator 30, 230.

A precise pattern of pressure pulses can therefore be generated through rotation of the rotor 30 degrees in a clockwise direction and 30 degrees in an anticlockwise direction. This pattern of pulses is used for amplitude shift keying (ASK) modulation where data is conveyed by changing the amplitude of the carrier wave. The frequency of pulses can also be varied by varying the rotational speed of the rotor 360 for conveying data by frequency-shift keying (FSK) modulation in addition to ASK modulation. As the rotor 60, 160, 260 is rotated in both clockwise and anticlockwise directions, there is less chance of wear than if the rotor is only being rotated in one direction. Furthermore, the span of rotation is limited to 60 degrees (30 degrees clockwise and 30 degrees anticlockwise), thereby reducing wear of the motor and seals etc associated with rotation. The frequency of pressure pulses 5, 6 that can be generated also beneficially increases with a reduced span of rotation of the rotor and, as a result, the data acquisition rate is amplified.

It will be evident from the foregoing that provision of more rotor fluid openings 67, 167, 267*a*, 267*b* will reduce the span of rotation further, thereby increasing the speed of data transmission. The number of fluid openings in the rotor directly correlates to the speed of data transmission; however, the number of fluid openings is limited by the circumferential area of the rotor being able to accommodate the fluid openings whilst still maintaining enough structural stability. In order to accommodate more fluid openings if data transmission speed is an important factor, the size of the fluid openings can be decreased to allow for more fluid openings to be present on the rotor.

A staged oscillation method can also be used to generate pressure pulses 6 as shown in FIG. 1*b* using the single fluid pressure pulse generator 330. The method involves oscillating the rotor 60, 160, 360 back and forth between the full flow and reduced flow configurations to generate pressure pulses 6. For the single fluid pressure pulse generator 330 of the first embodiment shown in FIGS. 18-21, the rotor 360 starts in the full flow configuration shown in FIG. 20 with the rotor fluid openings 367 aligned with the stator full flow chambers 342*a,b* so there is minimal pressure. The rotor 360 then rotates 45 degrees in an anticlockwise direction or 45 degrees in a clockwise direction to the reduced flow configuration where the rotor fluid openings 367 align with the stator walled sections 343*a,b* to generate pressure pulse 6. The frequency of pulses can be varied by varying the rotational speed of the rotor 360 for conveying data by frequency-shift keying (FSK) modulation. As the rotor 360 is rotated in both clockwise and anticlockwise directions, there may be less wear than if the rotor is only being rotated in one direction. Furthermore, the span of rotation is limited to 90 degrees (45 degrees clockwise and 45 degrees anticlockwise), thereby reducing wear of the motor and seals etc associated with rotation. For the single fluid pressure pulse generator 330 of the second embodiment shown in FIGS. 22-24, the same staged oscillation method can be used; however the rotor 60, 160 rotates 30 degrees from the full flow configuration to the reduced flow configuration in the clockwise or anticlockwise direction so the span of rotation is limited to 60 degrees. The staged oscillation method could also be used to generate pressure pulses 6 using a dual flow single fluid pressure pulse generator.

In alternative embodiments, the staged oscillation method can be used to generate a pattern of pressure pulses for other fluid pressure pulse generators, for example the stator may include two smaller flow chambers on either side of a larger flow chamber. A fluid opening in the rotor aligns with the larger flow chamber in the start position and aligns with one of the smaller flow chambers in position 1 and with the other smaller flow chamber in position 2. The amount of rotation of the rotor in each embodiment will depend on the spacing of the fluid openings in the rotor and the flow chambers in the stator. The innovative aspects apply equally in embodiments such as these.

Continuous Rotation Method

The dual fluid pressure pulse generator 30, 230 may generate pressure pulses 5, 6 as shown in FIG. 1*a*, through continuous rotation of the rotor 60, 160, 260 in one direction in the stator 40, 240. The frequency of pulses 5, 6 generated can be varied by varying the rotational speed of the rotor 60, 160, 260 for conveying data by frequency-shift keying (FSK) modulation. This continuous rotation method allows variation in the frequency of pulses generated, however the pattern of pulses is set with alternative full pressure pulses 6 and intermediate pressure pulses 5, rather than being able to choose the pulse pattern using the staged oscillation method described above. After time, the direction of rotation could be switched to reduce wear caused by continuously rotating in the same direction.

A continuous rotation method may also be used to generate pressure pulses 6 using the single fluid pressure pulse generator 330 as shown in FIG. 1*b*. The rotor 60, 160, 360 is continuously rotated in the single pulse stator 340*a,b* in one direction passing between the full flow and reduced flow configurations to generate pressure pulses 6. The frequency of pulses can be varied by varying the rotational speed of the rotor 60, 160, 360 for conveying data by frequency-shift keying (FSK) modulation. After time, the direction of rotation could be switched to reduce wear caused by continuously rotating in the same direction. The continuous rotation method could also be used to generate pressure pulses 6 using a dual flow single fluid pressure pulse generator.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. For example, whilst the MWD tool 20 has generally been described as being orientated with the pressure pulse generator 30, 230, 330 at the downhole end of the tool, the tool may be orientated with the pressure pulse generator 30, 230, 330 at the uphole end of the tool. The innovative aspects apply equally in embodiments such as these.

The invention in its broader aspects is therefore not limited to the specific details, representative apparatus and methods, and illustrative examples shown and described. Accordingly, departures may be made from such details without departing from the spirit or scope of the general concept.

The invention claimed is:

1. A fluid pressure pulse generator comprising:

(a) a stator comprising a stator body with a circular opening therethrough, wherein the stator body comprises one or more than one full flow chamber comprising a fluid chamber with an uphole axial fluid inlet and a lateral fluid outlet; and (b) a rotor comprising a circular rotor body rotatably received in the circular opening of the stator body, wherein the rotor body comprises one or more than one lateral fluid opening for flow of fluid therethrough and the lateral fluid opening is fluidly coupled to a curved depression on an external surface of the rotor body, whereby the curved depression is configured to direct fluid through the lateral fluid opening, wherein the rotor is rotatable between:

(i) a full flow configuration whereby the lateral fluid outlet of the full flow chamber and the lateral fluid opening align so that fluid flows from the fluid chamber through the lateral fluid opening; and (ii) a reduced flow configuration whereby the lateral fluid outlet of the full flow chamber and the lateral fluid opening are not aligned and the flow of fluid through the lateral fluid opening is less than the flow of fluid through the lateral fluid opening in the full flow configuration thereby generating a first fluid pressure pulse.

2. The fluid pressure pulse generator as claimed in claim 1, wherein the flow area of the fluid chamber is substantially equal to a flow area of the lateral fluid opening.

3. The fluid pressure pulse generator as claimed in claim 1, wherein a bottom surface of the fluid chamber is angled in the fluid flow direction for smooth flow of fluid from the fluid chamber to the lateral fluid opening.

4. The fluid pressure pulse generator as claimed in claim 1, wherein the full flow chamber includes a bypass channel for flow of fluid through the full flow chamber.

5. The fluid pressure pulse generator as claimed in claim 1, further comprising a channel in the external surface of the rotor body fluidly connecting the curved depression and the lateral fluid opening.

6. The fluid pressure pulse generator as claimed in claim 1, wherein the curved depression is sloped and increases in depth from an end furthest from the lateral fluid opening to an end closest to the lateral fluid opening.

7. The fluid pressure pulse generator as claimed in claim 6, wherein the curved depression is shaped like a spoon head.

8. The fluid pressure pulse generator as claimed in claim 1, wherein the rotor body comprises a plurality of lateral fluid openings with leg sections positioned therebetween with an edge of each leg section perpendicular to a direction of rotation of the rotor, a wall thickness of the edge of the leg section being less than a wall thickness of a middle part of the leg section.

9. The fluid pressure pulse generator as claimed in claim 1, wherein the stator body further comprises one or more than one wall section on an internal surface of the stator body whereby the lateral fluid opening of the rotor body aligns with the wall section in the reduced flow configuration.

10. The fluid pressure pulse generator as claimed in claim 9, wherein a portion of the fluid chamber is positioned behind the wall section.

11. A fluid pressure pulse generator comprising:

(a) a stator comprising a stator body with a circular opening therethrough; and (b) a rotor comprising a circular rotor body rotatably received in the circular opening of the stator body, wherein one of the stator body or the rotor body comprises one or more than one lateral fluid opening for flow of fluid therethrough and the other of the stator body or the rotor body comprises one or more than one full flow chamber and one or more than one intermediate flow chamber with a flow area less than a flow area of the full flow chamber, the full flow chamber comprising a fluid chamber with an uphole axial fluid inlet and a lateral fluid outlet and the intermediate flow chamber comprising an intermediate fluid chamber with an uphole axial fluid inlet and a lateral fluid outlet, wherein the rotor is rotatable between:

(i) a full flow configuration whereby the lateral fluid outlet of the full flow chamber and the lateral fluid opening align so that fluid flows from the fluid chamber through the lateral fluid opening;

(ii) a reduced flow configuration whereby the lateral fluid outlet of the full flow chamber and the lateral fluid opening are not aligned and the flow of fluid through the lateral fluid opening is less than the flow of fluid through the lateral fluid opening in the full flow configuration thereby generating a first fluid pressure pulse; and (iii) an intermediate flow configuration whereby the lateral fluid outlet of the intermediate flow chamber and the lateral fluid opening align so that fluid flows from the intermediate fluid chamber through the lateral fluid opening, and the flow of fluid through the lateral fluid opening in the intermediate flow configuration is less than the flow of fluid through the lateral fluid opening in the full flow configuration but more than the flow of fluid through the lateral fluid opening in the reduced flow configuration thereby generating a second fluid pressure pulse which is reduced compared to the first fluid pressure pulse.

12. A measurement while drilling tool comprising the fluid pressure pulse generator as claimed in claim 1 and a pulser assembly with a drive shaft, wherein the rotor of the fluid pressure pulse generator is fixed to the drive shaft for rotation thereby.

13. The fluid pressure pulse generator as claimed in claim 11, wherein the flow area of the intermediate fluid chamber is less than the flow area of the lateral fluid opening.

14. The fluid pressure pulse generator as claimed in claim 11, wherein a bottom surface of the intermediate fluid chamber is angled in the fluid flow direction for smooth flow of fluid from the intermediate fluid chamber to the lateral fluid opening.

15. The fluid pressure pulse generator as claimed in claim 11, wherein the intermediate flow chamber includes a bypass channel for flow of fluid through the intermediate flow chamber.

16. A stator for a fluid pressure pulse generator, the stator comprising a stator body with a circular opening therethrough configured to receive a circular rotor for rotation therein, the stator body comprising one or more than one full flow chamber comprising a fluid chamber in a wall of the stator body with an uphole axial fluid inlet and a lateral fluid outlet, wherein the lateral fluid outlet is configured to align with one or more than one lateral fluid opening in the rotor such that there is flow of fluid from the fluid chamber through the lateral fluid opening.

17. The stator as claimed in claim 16, wherein a bottom surface of the fluid chamber is angled in the fluid flow direction for smooth flow of fluid from the fluid chamber to the lateral fluid opening.

18. The stator as claimed in claim 16, further comprising a wall section on an internal surface of the stator body configured to align with the lateral fluid opening in the rotor.

19. The stator as claimed in claim 18, wherein a portion of the fluid chamber is positioned behind the wall section.

20. The stator as claimed in claim 16, wherein the full flow chamber includes a bypass channel for flow of fluid through the full flow chamber.

21. The stator as claimed in claim 16, wherein the stator body further comprises one or more than one intermediate flow chamber with a flow area less than a flow area of the full flow chamber, wherein the intermediate flow chamber comprises an intermediate fluid chamber with an uphole axial fluid inlet and a lateral fluid outlet, wherein the lateral fluid outlet of the intermediate flow chamber is configured to align with the lateral fluid opening in the rotor such that there is flow of fluid from the intermediate flow chamber through the lateral fluid opening.

22. The stator as claimed in claim 21, wherein a bottom surface of the intermediate fluid chamber is angled in the fluid flow direction for smooth flow of fluid from the intermediate fluid chamber to the lateral fluid opening.

23. The stator of claim 21, wherein the intermediate flow chamber includes a bypass channel for flow of fluid through the intermediate flow chamber.

24. A rotor for a fluid pressure pulse generator, the rotor comprising a circular body with a lateral fluid opening therethrough and a curved depression on an external surface of the circular body, the curved depression being uphole and fluidly coupled to the lateral fluid opening, the curved depression configured to direct fluid flowing along the external surface of the circular body through the lateral fluid opening.

25. The rotor as claimed in claim 24, wherein the curved depression is sloped and increases in depth from an end furthest from the lateral fluid opening to an end closest to the lateral fluid opening.

26. The rotor as claimed in claim 25, wherein the curved depression is shaped like a spoon head.

27. The rotor as claimed in claim 24, further comprising a channel in the external surface of the circular body fluidly connecting the curved depression and the lateral fluid opening.

28. The rotor as claimed in claim 24, wherein the circular body comprises a plurality of lateral fluid openings with leg sections positioned therebetween with an edge of each leg section perpendicular to a direction of rotation of the rotor, a wall thickness of the edge of the leg section being less than a wall thickness of a middle part of the leg section.

29. A measurement while drilling tool comprising a pulser assembly with a drive shaft and the rotor as claimed in claim 24 fixed to the drive shaft for rotation thereby.

30. A measurement while drilling tool system comprising the measurement while drilling tool of claim 29 and a plurality of the stators as claimed in claim 16, wherein the stator bodies of the plurality of stators have the same sized circular opening for receiving the circular body of the rotor and various different sized external dimensions to fit various different sized drill collars used for downhole drilling.

* * * * *